US006666258B1

(12) United States Patent
Kono

(10) Patent No.: US 6,666,258 B1
(45) Date of Patent: Dec. 23, 2003

(54) METHOD AND APPARATUS FOR SUPPLYING MELTED MATERIAL FOR INJECTION MOLDING

(75) Inventor: Kaname Kono, Tokyo (JP)

(73) Assignee: Takata Corporation, Tokyo (JP)

( * ) Notice: Subject to any disclaimer, the term of this patent is extended or adjusted under 35 U.S.C. 154(b) by 0 days.

(21) Appl. No.: 09/609,256

(22) Filed: Jun. 30, 2000

(51) Int. Cl.[7] ..... B22D 17/00; B22D 17/10
(52) U.S. Cl. ..... 164/312; 164/900
(58) Field of Search ..... 164/113, 312, 164/900, 133, 136, 335, 337, 66.1; 425/557, 561; 222/591, 592, 596

(56) References Cited

U.S. PATENT DOCUMENTS

| | | | |
|---|---|---|---|
| 2,386,966 | A | 10/1945 | MacMillin |
| 2,505,540 | A | 4/1950 | Goldhard |
| 2,529,146 | A | 11/1950 | Feitl |

(List continued on next page.)

FOREIGN PATENT DOCUMENTS

| | | |
|---|---|---|
| DE | 196 11 419 | 9/1996 |
| EP | TA 153528 | 3/1991 |
| EP | 0 476 843 | 3/1992 |
| EP | EU 0 476 843 | 3/1992 |
| EP | EU 0 761 344 | 3/1997 |
| FR | 1.447.606 | 11/1966 |
| JP | 1 166874 | 6/1989 |
| JP | 1 178345 | 7/1989 |
| JP | 2 274360 | 11/1990 |
| JP | 5-8016 | 1/1993 |
| JP | 5-8017 | 1/1993 |
| JP | EU 05008017 | 1/1993 |
| JP | 5 285626 | 11/1993 |
| JP | 5 285627 | 11/1993 |
| JP | 6 306507 | 11/1994 |
| JP | 7 51827 | 2/1995 |
| JP | 8 72110 | 3/1996 |
| JP | 8 174172 | 7/1996 |
| JP | 8 252661 | 10/1996 |
| JP | 9 103859 | 4/1997 |
| JP | 9 155524 | 6/1997 |
| JP | 9-155526 | 6/1997 |
| JP | 9 155527 | 6/1997 |
| JP | 9 295122 | 11/1997 |
| WO | WO 97/21509 | 6/1997 |
| WO | WO 97/45218 | 12/1997 |
| WO | WO 99/28065 | 6/1999 |
| WO | WO 99/50007 | 10/1999 |

OTHER PUBLICATIONS

Flemings et al.: "Rheocasting," Materials Science and Engineering, 1976, vol. 25, pp. 103–117.

Worthy: "Injection Molding of Magnesium Alloys," Chemical & Engineering News, Jun. 1988, pp. 29–30.

Tissier et al.: "Magnesium Rheocasting: A Study of Processing–Microstructure Interactions," Journal of Materials Science, 1990, vol. 25, pp. 1184–1196.

Carnahan et al.: "New Manufacturing Process for Metal Matrix Composite Synthesis," Fabrication of Particulates Reinforced Composites, Proceedings of an International Conference, Sep. 1990, pp. 101–105.

Pasternak et al.: "Semi–Solid Production Processing of Magnesium Alloys by Thixomolding," Proceedings of the Second International Conference on the Semi–Solid Processing of Alloys and Composites, Jun. 1992, pp. 159–169.

(List continued on next page.)

*Primary Examiner*—M. Alexandra Elve
*Assistant Examiner*—Kevin P. Kerns
(74) *Attorney, Agent, or Firm*—Foley & Lardner

(57) ABSTRACT

An injection molding system includes a melt furnace in which a metal is melted, a feeder suitable for holding the melted metal, an injection chamber containing a first piston and an injection nozzle, a first conduit connecting the melt furnace to the feeder and a second conduit connecting the feeder to the injection chamber.

54 Claims, 23 Drawing Sheets

U.S. PATENT DOCUMENTS 2,785,448 A 3/1957 Hodler
3,048,892 A 8/1962 Davis, Jr. et al.
3,106,002 A 10/1963 Bauer
3,123,875 A 3/1964 Madwed
3,172,174 A 3/1965 Johnson
3,189,945 A 6/1965 Strauss
3,201,836 A 8/1965 Nyselius
3,254,377 A 6/1966 Morton
3,268,960 A 8/1966 Morton
3,270,378 A 9/1966 Madwed
3,270,383 A 9/1966 Hall et al.
3,319,702 A 5/1967 Hartwig et al.
3,344,848 A 10/1967 Hall et al.
3,447,593 A 6/1969 Nyselius
3,474,854 A 10/1969 Mace
3,491,827 A 1/1970 Mace
3,529,814 A 9/1970 Werner
3,550,207 A 12/1970 Strauss
3,693,702 A 9/1972 Piekenbrink et al.
3,773,873 A 11/1973 Spaak et al.
3,810,505 A 5/1974 Cross
3,814,170 A 6/1974 Kahn
3,874,207 A 4/1975 Lemelson
3,893,792 A 7/1975 Laczko
3,902,544 A 9/1975 Flemings et al.
3,936,298 A 2/1976 Mehrabian et al.
3,976,118 A 8/1976 Kahn
4,049,040 A 9/1977 Lynch
4,088,178 A 5/1978 Ueno et al.
4,168,789 A 9/1979 Deshais et al.
4,212,625 A 7/1980 Shutt
4,287,935 A 9/1981 Ueno et al.
4,330,026 A 5/1982 Fink
4,347,889 A 9/1982 Komatsu et al.
4,387,834 A 6/1983 Bishop
4,434,839 A 3/1984 Vogel
4,436,140 A 3/1984 Ebisawa et al.
4,473,103 A 9/1984 Kenney et al.
4,476,912 A 10/1984 Harvill
4,510,987 A 4/1985 Collot
4,534,403 A 8/1985 Harvill
4,537,242 A 8/1985 Pryor et al.
4,559,991 A 12/1985 Motomura et al.
4,586,560 A 5/1986 Ikeya et al.
4,635,706 A * 1/1987 Behrens ..... 164/500
4,687,042 A 8/1987 Young
4,694,881 A 9/1987 Busk
4,694,882 A 9/1987 Busk
4,730,658 A 3/1988 Nakano
4,771,818 A 9/1988 Kenney
4,828,460 A 5/1989 Saito et al.
4,834,166 A 5/1989 Nakano
4,884,621 A 12/1989 Ban et al.
4,898,714 A 2/1990 Urban et al.
4,952,364 A 8/1990 Matsuda et al.
4,997,027 A 3/1991 Akimoto
5,040,589 A 8/1991 Bradley et al.
5,109,914 A * 5/1992 Kidd et al. ..... 164/113
5,143,141 A 9/1992 Frulla
5,144,998 A 9/1992 Hirai et al.
5,161,598 A 11/1992 Iwamoto et al.
5,181,551 A 1/1993 Kidd et al.
5,186,236 A 2/1993 Gabathuler et al.
5,191,929 A * 3/1993 Kubota et al. ..... 164/500
5,205,338 A 4/1993 Shimmell
5,244,033 A * 9/1993 Ueno ..... 164/312
5,375,645 A 12/1994 Brueker et al.
5,380,187 A 1/1995 Fujikawa
5,388,633 A * 2/1995 Mercer, II et al. ..... 164/457
5,394,931 A 3/1995 Shiina et al.
5,413,644 A 5/1995 Marder et al.
5,501,266 A * 3/1996 Wang et al. ..... 164/113
5,531,261 A 7/1996 Yoshida et al.
5,533,562 A 7/1996 Moschini et al.
5,571,346 A 11/1996 Bergsma
5,575,325 A 11/1996 Sugiura et al.
5,577,546 A 11/1996 Kjar et al.
5,601,136 A 2/1997 Shimmell
5,622,216 A 4/1997 Brown
5,623,984 A 4/1997 Nozaki et al.
5,630,463 A 5/1997 Shimmell
5,630,466 A 5/1997 Garat et al.
5,638,889 A 6/1997 Sugiura et al.
5,657,812 A 8/1997 Walter et al.
5,662,159 A 9/1997 Iwamoto et al.
5,664,618 A 9/1997 Kai et al.
5,665,302 A 9/1997 Beni et al.
5,680,894 A 10/1997 Kilbert
5,685,357 A 11/1997 Kato et al.
5,697,422 A 12/1997 Righi et al.
5,697,425 A 12/1997 Nanba et al.
5,701,942 A 12/1997 Adachi et al.
5,704,411 A 1/1998 Suzuki et al.
5,716,467 A 2/1998 Marder et al.
5,730,198 A 3/1998 Sircar
5,730,202 A 3/1998 Shimmell
5,735,333 A 4/1998 Nagawa
5,770,245 A 6/1998 Takizawa et al.
5,836,372 A 11/1998 Kono
5,839,497 A 11/1998 Fujino et al.
5,861,182 A 1/1999 Takizawa et al.
5,913,353 A * 6/1999 Riley et al. ..... 164/113
5,983,976 A * 11/1999 Kono ..... 164/113
6,065,526 A 5/2000 Kono
6,135,196 A * 10/2000 Kono ..... 164/113
6,241,001 B1 6/2001 Kono
6,276,434 B1 8/2001 Kono
6,283,197 B1 9/2001 Kono
6,284,167 B1 9/2001 Fujikawa
6,540,006 B2 * 4/2003 Kono ..... 164/113

OTHER PUBLICATIONS

Staff Report: "Semi–Solid Metalcasting Gains Acceptance, Applications," Foundry Management & Technology, Nov. 1995, pp. 23–26.

Takao: "Pressure Measuring Device of Plasticizing Material in Injection Molding and Injection Molding Machine," Patent Abstracts of Japan, Oct. 29, 1990, vol. 014, No. 495, Publication No. 02 202420; Publication Date—Aug. 10, 1990; Abstract.

Keizo: "Method and Apparatus for Continuously Forming Metallic Slurry for Continuous Casting," Patent Abstracts of Japan, Nov. 2, 1989, vol. 013, No. 484, Publication No. 01 192447, Publication Date—Aug. 2, 1989, Abstract.

Kenjiro: "Method for Injection Molding Foamed and Molded Item," Patent Abstracts of Japan, Dec. 26, 1984, vol. 008, No. 284, Publication No. 59 152826, Publication Date—Aug. 31, 1984, Abstract.

R. Mehrabian et al.: "Casting in the Liquid–Solid Region," New Trend in Materials Processing, Papers presented at a seminar of AST, Oct. 19 and 20, 1974, ASM, 98–127 (1974).

M. Suery et al.: "Effect of Strain Rate on Deformation Behavior of Semi–Solid Dendritic Alloys," *Metall. Trans. A.,* 1982, vol. 13A, No. 10: 1809–1819.

M.C. Flemings et al.: "Rheocasting," *McGraw–Hill Yearbook of Science and Technology,* 1978, pp. 49–59.

V. Laxmanan et al.: "Deformation of Semi–Solid Sn–15 Pct. Pb Alloy," *Metall. Trans. A.,* 1980, vol. 11A: 1927–1937.

T. Matsumiya et al.: "Modeling of Continuous Strip Production by by Rheocasting," *Metal. Trans. B.,* 1981, vol. 12 B: 17–31.

S.B. Brown et al.: "Net Shape Forming via Semi–Solid Processing," *Advanced Materials & Processes,* 1993, vol. 143, No. 1: 36–40.

M.C. Flemings: "Behavior of Metal Alloys in the Semisolid State," *Metallurgical Transactions B,* 1991, vol. 22B, No. 3: 269–293.

Material Science & Technology Textbook Fig. 1–67(b).

Conference Material, Sodick Plastech Co., Ltd., Misao Fujikawa, Jul. 1995.

Tuparl Injection Molding Machine Advertisement.

"Plastic Processing Technology Book," Published in Japan.

R.D. Carnahan: "Advances in Thixomolding," 52$^{nd}$ Annual World Magnesium Conference, May 17–19, 1994, Berin, Germany.

Kalpakjian, Serope, *Manufacturing Processes for Engineering Materials,* 3rd edition, Addison Wesley Longman, Inc., Menlo Park, CA, 1997, pp. 261–263, 265–266.

* cited by examiner

METHOD AND APPARATUS FOR SUPPLYING MELTED MATERIAL FOR INJECTION MOLDING

BACKGROUND OF THE INVENTION

1. Field of the Invention

The invention relates to an injection molding method and apparatus, and more particularly to a method and apparatus for manufacturing metallic parts by injection molding using a separate ingot melt furnace and feeder.

2. Description of the Related Art

Injection molding is a known method used to produce molded metallic parts from melted metal. A conventional injection molding apparatus 1 is illustrated in FIG. 1. In an injection molding method using apparatus 1, metal ingots or particles 3 are supplied directly to a melt feeder or hopper 5 in the solid state. The ingots 3 settle to the bottom of the melt feeder 5, and rest on a filter 7, such as a grate, while they are melted by heaters 9. The melted metal 11 is then released into an injection chamber 13. The melt feeder 5 contains a pipe 15 which supplies an inert protective gas, such as argon or nitrogen, to the melt feeder to drive out any air which may have become trapped in the molten metal 11, as described for example in U.S. Pat. No. 5,501,266, incorporated herein by reference in its entirety. The molten metal 11 is then injected into a mold cavity 17 by a piston or plunger 19. The piston may have a shape of a rod or a screw extending throughout the length of the injection chamber 13, past the opening to the feeder 5, as described in U.S. Pat. No. 5,501,266. The metal 11 solidifies in the mold cavity 17 to form the molded metallic part. However, this prior art method and apparatus suffer from several disadvantages.

The melt feeder 5 must contain a certain minimum volume of the molten metal 11 in order to allow a continuous, uninterrupted operation of the injection molding apparatus 1. Thus, the melt feeder 5 must have a minimum height in order to hold at least the minimum volume of the molten metal 11. For example, the melt feeder 5 should have a height of about four feet in order to ensure the uninterrupted operation of the apparatus 1.

A delivery system, such as a conveyor 21 or a downwardly sloped surface, which delivers the ingots or pellets 3 to the melt feeder 5 is located above the melt feeder, as illustrated in FIG. 1. The ingots 3 are dropped into the melt feeder 5 by the delivery system 21 from a relatively large height, such as 4–5 feet. The drop causes the ingots 3 to create a splash on contact with the molten metal 11 present in the melt feeder 5. The splashed molten metal hits the upper portions of the metal feeder 5 and the pipe 15 and solidifies as plaque 23, because the upper portions of the melt feeder 5 and the pipe 15 are maintained at a lower temperature than the lower portions of the melt feeder for safety reasons. This is particularly true for a metal such as magnesium which can easily catch fire when it contacts air surrounded by a wall of a higher temperature.

The plaque 23 blocks the egress from the pipe 15, interfering with the delivery of the protective inert gas and forms thick deposits on the walls of the melt feeder 5, which requires expensive and time consuming maintenance to remove these deposits. The apparatus 1 has to be taken off line during maintenance, further increasing manufacturing expenses. The present invention is directed at overcoming or at least reducing these and other problems of the prior art.

SUMMARY OF THE INVENTION

In one aspect of the present invention, there is provided a method of forming a molded object, comprising introducing solid material into a first chamber, melting the solid material in the first chamber, transferring the melted material from the first chamber into a second chamber, transferring the melted material from the second chamber into a third chamber, transferring the melted material from the third chamber into a mold cavity, and solidifying the melted material in the mold cavity to form the molded object.

In another aspect of the present invention, there is provided an injection molding apparatus, comprising a first chamber means for melting a solid material, a second chamber means for holding the melted material, a third chamber means for holding the melted material to be transferred into a mold cavity, a first conduit means for transferring the melted material from the first chamber means to the second chamber means, a second conduit means for transferring the melted material from the second chamber means to the third chamber means, and a first piston means in the third chamber means for transferring the melted material from the third chamber means to a mold cavity.

In another aspect of the present invention, there is provided an injection molding apparatus, comprising a melt furnace suitable for melting a metal, a feeder suitable for holding the melted metal, an injection chamber containing a first piston and an injection nozzle, a first conduit connecting the melt furnace to the feeder, and a second conduit connecting the feeder to the injection chamber.

In another aspect of the present invention, there is provided an injection molding apparatus, comprising a melt furnace suitable for melting a metal, a screening element adjacent to a bottom of the melt furnace comprising at least one non-horizontal wall, a top and a melt furnace outlet on at least one wall, an injection chamber containing a piston and an injection nozzle, and a conduit connecting the melt furnace outlet to the injection chamber.

BRIEF DESCRIPTION OF THE DRAWINGS

The invention is described in detail herein with reference to the drawings in which.

DETAILED DESCRIPTION OF THE PREFERRED EMBODIMENTS

The present inventor has discovered that plaque formation in the feeder may be reduced or even completely avoided if the metal is supplied to the feeder in a melted state. Preferably, the melted metal is supplied to the feeder in a liquid state. However, while less preferred, the metal may be supplied to the feeder in a thixotropic state.

The term "feeder" means any chamber that receives the metal in a melted state, preferably in a liquid state, and that supplies the melted metal to an injection chamber, either directly, or via an intermediary chamber, such as a temperature controlled barrel. The "feeder" is different from the prior art "melt feeders" which receive the metal in the solid state (i.e., metal ingots or pellets) and which are used to melt the supplied solid metal ingots or pellets. The melted metal in the feeder is not disturbed by the dropping of the solid ingots or pellets into it.

Preferably, during operation of the injection molding apparatus, the volume of the melted metal in the feeder exceeds the amount of melted metal injected into a mold with each injection stroke by at least a factor of two. While not required, the feeder may be a chamber that is adapted to supply a constant flow of melted metal toward the injection chamber to allow a substantially uninterrupted operation of the injection molding apparatus, where the flow may be interrupted by the injection stroke of an injection piston or plunger or other elements in the injection molding apparatus.

In order to avoid or reduce plaque formation in the feeder and to supply the metal in the melted state to the feeder, the solid metal raw material, such as one or more metal ingots or pellets, is preferably supplied to a melt furnace, where it is melted (i.e., converted to a liquid or a thixotropic state). The melted metal is then supplied from the melt furnace to the feeder. A "melt furnace" means any chamber where a metal may be melted. For example, the melt furnace may be a tank or a pot surrounded by resistive heating elements which heat the metal inside the pot above the melting point of the metal. Alternatively, the melt furnace may be a chamber where the metal is melted by the application of heat from a gas burner, by an application of an electromagnetic field to the metal (i.e., inductively, etc.), by an application of an arc discharge to the metal or by irradiation of the metal with a laser.

1. The Injection Molding Apparatus 101

Figure 2:
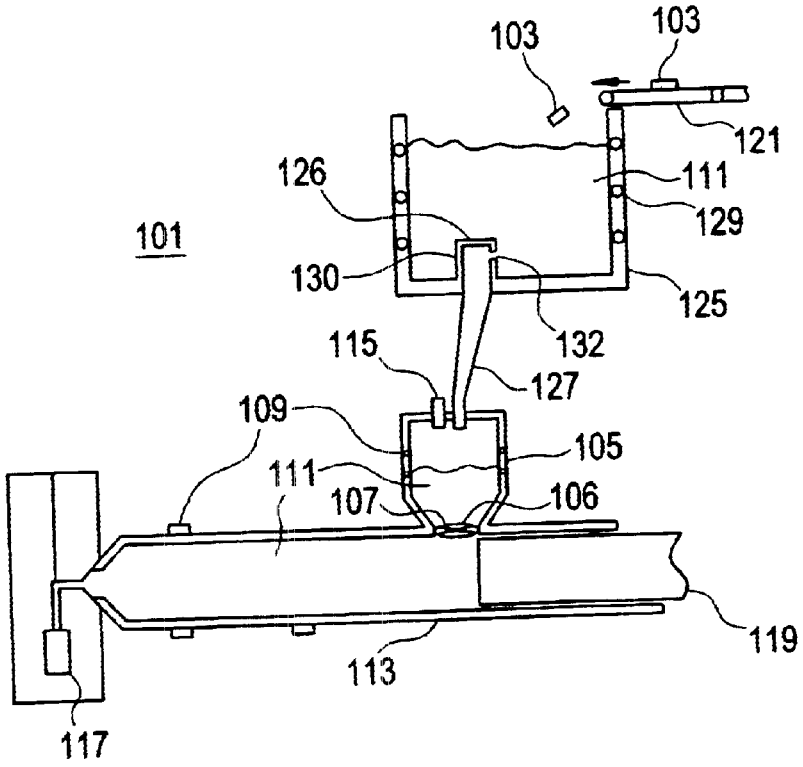
FIG. 2 is a schematic illustration of a side cross sectional view of an injection molding system according to one aspect of the first preferred embodiment of the present invention.

FIG. 2 illustrates an injection molding apparatus 101 according to a first preferred embodiment of the invention. The apparatus 101 contains a feeder 105. The feeder preferably contains a check valve 106. The feeder may also contain a filter 107, if desired. However, unlike the prior art, a filter is not necessary since the metal is supplied to the feeder 105 in a melted state. The feeder contains heating elements 109, such as resistive or inductive heaters, which maintain the melted metal 111 in a liquid or a thixotropic state. The heating elements 109 may be disposed in the walls of the feeder 105, on the outer surface of the feeder 105 or adjacent to the feeder 105. The feeder 105 also preferably contains a pipe, inlet or opening 115 which supplies an inert protective gas, such as argon, nitrogen, $SF_6$ and/or $CO_2$, to the feeder 105 to drive out any air which may have become trapped in the molten metal 111. However, the protective gas inlet may be omitted, if desired. Preferably, the top of the feeder is covered to prevent spillage of melted metal during an injection step which causes the feeder to move forward.

The feeder 105 preferably contains at least a certain minimum volume of the molten metal 111 in order to allow substantially continuous, uninterrupted operation of the apparatus 101.

The apparatus 101 also contains an injection chamber 113. The molten metal 111 is transferred from the feeder 105 to the injection chamber 113, either directly thorough an opening or through an intermediate chamber. The injection chamber is preferably surrounded by resistive or inductive heaters 109 which are used to maintain the melted metal 111 in the liquid or thixotropic state within the injection chamber 113. The injection chamber 113 is illustrated in FIG. 2 as being positioned horizontally. However, the injection chamber 113 may be positioned vertically or at any desired angle of inclination.

The injection chamber 113 contains a piston or a plunger 119 which is used to inject the melted metal 111 from the injection chamber 113 into a mold cavity 117. When the piston 119 retracts, the check valve 106 opens and allows the melted metal 111 to flow into the injection chamber 113 from the feeder 105. When the piston 119 moves forward to inject the melted metal 111 into the mold cavity 117, the check valve 106 closes to prevent a portion of the melted metal 111 from flowing back into the feeder 105 from the injection chamber 113. Thus the use of the check valve 106 allows the amount of the shot (i.e., the volume of melted metal) injected into the mold cavity 117 to remain relatively constant with each injection stroke of the piston 119.

As shown in FIG. 2, the piston 119 has a shape of a thick rod having a diameter that is slightly less than the inner diameter of the injection chamber 113. However, the piston may have other shapes, if desired. For example the piston 119 may have a "T" shape comprising a rod having a diameter substantially smaller than the inner diameter of the injection chamber 113, supporting a plunger surface having a diameter that is slightly less than the inner diameter of the injection chamber 113. Alternatively, the piston 119 may comprise a screw which meters and advances forward the melted metal 111 flowing in from the feeder 105 and having a tip which injects the melted metal 111 into the mold cavity 117.

2. The Melt Furnace 125

Figure 1:
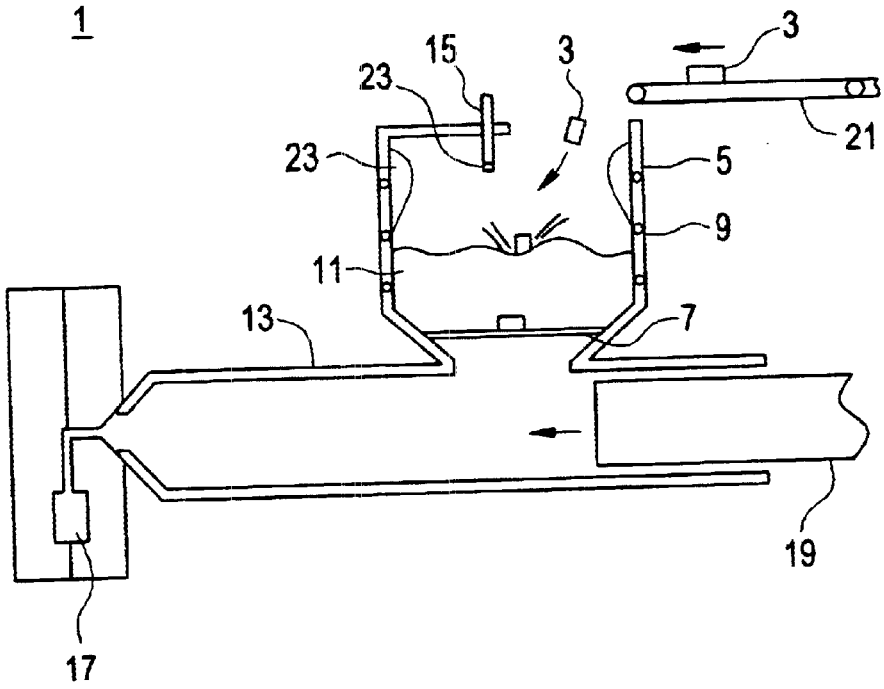
FIG. 1 PRIOR ART
FIG. 1 is a schematic illustration of a side view of prior art injection molding system.

Unlike the prior art apparatus shown in FIG. 1, the apparatus of a preferred embodiment of the present invention contains a melt furnace 125, as illustrated in FIG. 2. The solid metal ingots or pellets 103 are delivered into the melt furnace 125 by a delivery system 121, such as a conveyor or a downwardly sloped surface. Alternatively, the metal ingots or pellets 103 may be placed into the melt furnace 125 manually, if desired.

In a preferred aspect of the present invention, the melt furnace 125 contains an outlet screening element 126. For example, as illustrated in FIG. 2, the screening element 126 may comprise at least one non-horizontal wall 130, a top cover or portion and an outlet port 132. Preferably, the melt furnace outlet port 132 is located in one of the walls instead of in the top of the screening element 126. The screening element 126 may contain one wall if the element 126 has a cylindrical shape or plural walls if the element 126 has a polygonal shape. Furthermore, the non-horizontal wall 130 is preferably exactly vertical or substantially vertical (i.e., deviating by about 1–20 degrees from vertical). The screening element 126 prevents solid metal pellets or ingots 103 as well as other residue present in the melted metal 111 from clogging the outlet port 132. Metal ingots 103 may sink to the bottom of the melt furnace 125 and lie flat. This positioning of the ingots is not desirable because the ingots may substantially block melted metal 111 flow from the melt furnace 125. The vertical walls 130 prevent the ingots 103 from lying across the outlet port 132. Furthermore, various residue accumulates on the bottom of the melt furnace 125. By placing the outlet port 132 above the bottom of the melt furnace, the residue located on the bottom of the melt furnace does not clog the outlet port 132. However, the screening element 126 may be omitted, if desired.

In an alternative aspect of the present invention, the screening element 126 may comprise a filter, such as a grate or a screen, containing opening(s) large enough for liquid or thixotropic melted metal 111 to pass through, but small enough to prevent the unmelted solid metal pellets or ingots 103 from passing into the outlet port 132.

In another alternative aspect of the present invention, the screening element 126 may also comprise at least one substantially vertical containment rod. The rod(s) may be of any shape, as long as they prevent the sinking ingots 103 from laying flat across the outlet port 132 and blocking it.

The melt furnace 125 is connected to the feeder 105 by a conduit 127, as illustrated in FIG. 2. Preferably, the conduit 127 is a pipe having a sufficient inner diameter to deliver melted metal 111 from the melt furnace 125 to the feeder 105. The preferred inner diameter of the conduit is 25–45 mm, most preferably 40 mm. The melt furnace 125 also contains heating elements 129, such as resistive or inductive heaters, which maintain the melted metal 111 in a liquid or thixotropic state. The heating elements 129 may be disposed in the walls of the melt furnace 125, on the outer surface of the melt furnace 125 or adjacent to the melt furnace 125.

The melt furnace 125 may comprise any chamber where a metal may be melted. For example, the melt furnace may be a pot surrounded by resistive heating elements which heat the metal inside the pot above the melting point of the metal. The melt furnace 125 may be made of any material suitable for melting a metal. For example, the melt furnace may be made of iron or high temperature ceramic for melting magnesium alloy ingots or pellets.

Preferably, the melt furnace 125 has a larger volume than the feeder 105. For example, in one preferred aspect of the present invention, the feeder 105 contains an amount of melted metal 111 sufficient for one to three injection shots, while the melt furnace 125 contains an amount of melted metal 111 sufficient for four to fifty injection shots. The feeder 105 and melt furnace 125 may have any dimensions sufficient to produce an injection molded article. For example, the feeder 105 may be about 20 cm high and about 20 cm wide and the melt furnace 125 may be 50 to 70 cm high and about 100 cm wide. However, other dimensions could be used if desired.

The melted metal 111 flowing from the melt furnace 125 into the feeder 105 in FIG. 2 causes substantially less or no splashing than the solid ingots 3 which are dropped directly into the melted metal 11 in the feeder 5 in the prior art apparatus 1, illustrated in FIG. 1. Thus, very little or no plaque 23 builds up in the feeder 105 of the preferred embodiment of the present invention. The addition of the melt furnace 125 is also advantageous because it decreases the amount of air entrapped into the melted metal 111 injected into the mold cavity 117. Since the metal is supplied to the feeder 105 in the melted state through a conduit 127, the feeder 105 may be entirely enclosed from the outside atmosphere. In contrast, the melt feeder 5 in the prior art apparatus 1 is open to the outside atmosphere in order to receive the solid ingots or pellets 3. This allows air to enter the melt feeder 5 and eventually wind up in the molded metal part in the mold cavity 17.

There may be one melt furnace 125 for each feeder 105 as illustrated in FIG. 2, or there may be one melt furnace 125 connected to plural feeders 105 by plural conduits 127. The melt furnace 125 may be detachable from the remaining portions of the apparatus 101, such that the plaque build up may be removed from the melt furnace 125 without taking the remaining injection molding apparatus off-line. In this aspect of the invention, there may be plural melt furnaces 125 connected to one or more feeders 105 to allow one melt furnace to be taken off line, for servicing or repair, without taking any injection molding apparatus 101 off-line with it.

As shown in FIG. 2, the melt furnace 125 is located above the feeder 105, in order to feed the melted metal 111, preferably in the liquid state, into the feeder 105 by the force of gravity through the conduit 127. Alternatively, as illustrated in FIG. 3, the melt furnace 125 may be located off to one side of the feeder 105.

Furthermore, the conduit 127 is illustrated as entering the top of the feeder 105 in FIG. 2. However, in another aspect of the present invention, the conduit 127 may enter the side of feeder 105, above or below the operational level (i.e. fill line) of the melted metal 111, as illustrated in FIG. 3. This arrangement of the conduit 127 and the feeder 105 is advantageous because the melted metal 111 enters the feeder 105 either near or below the fill line of the feeder, further minimizing the splashing of the melted metal 111 present in the feeder 105.

Figure 3:
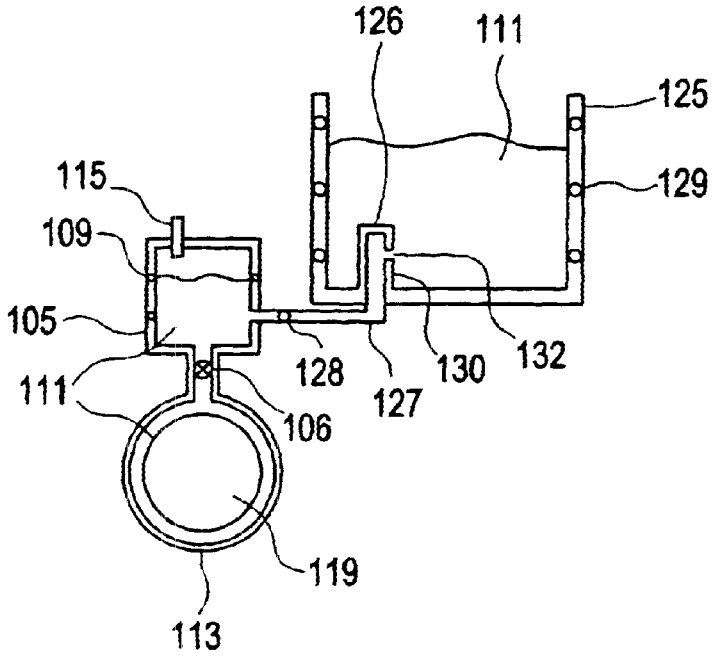
FIG. 3 is a schematic illustration of a back cross sectional view of the injection molding system according to another aspect of the first preferred embodiment of the present invention.

In an alternative aspect of the present invention, a check valve 128 may be placed in or adjacent to the conduit 127 to meter or control the amount of melted metal 111 being supplied to the feeder 105, as illustrated in FIG. 3. The check valve 128 may be opened by a controller, such as a computer or a microprocessor, intermittently (i.e., after each forward stroke of the first piston 119, etc.) or in response to a low melted metal volume signal from a level sensor in the feeder 105.

Figure 4:
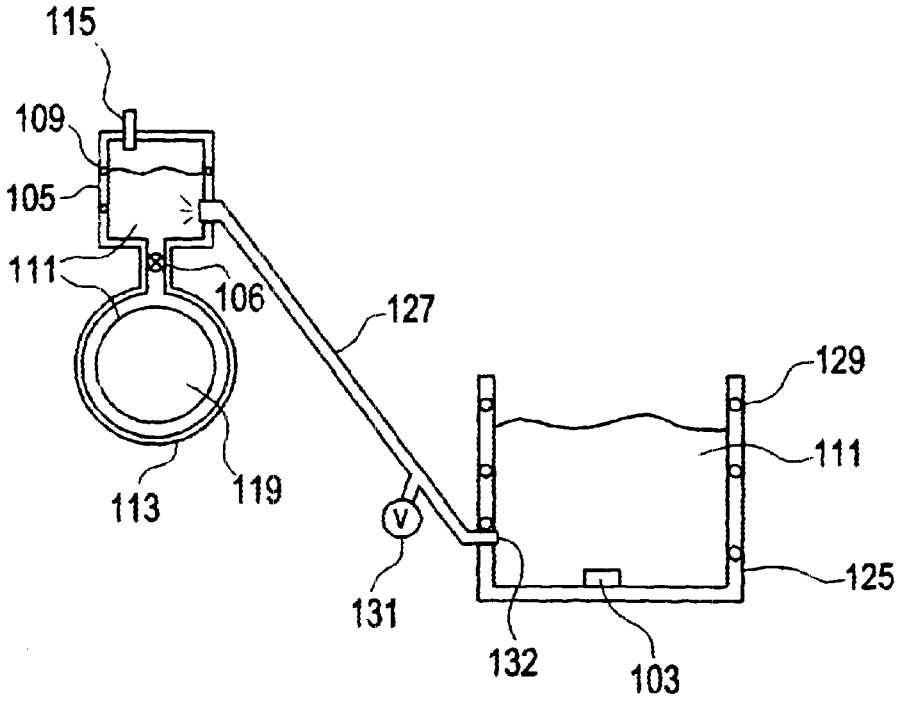
FIG. 4 is a schematic illustration of a back cross sectional view of the injection molding system according to a second preferred embodiment of the present invention.

Alternatively, the melt furnace 125 may also have a lower region with a bottom surface that is at a lower position than the outlet port 132. The ingots 103 will melt in the lower region without blocking the outlet port 132. For example, the conduit 127 inlet may be located on the side of the melt furnace 125 to prevent the ingots 103 and residue from blocking the outlet port 132, as illustrated in FIG. 4.

According to a second preferred embodiment of the present invention, the melted metal 111 is drawn from the melt furnace 125 into the feeder 105 by suction. In one aspect of the second embodiment, the suction is created by a pump 131. As illustrated in FIG. 4, the pump 131 is located in fluid communication with the conduit 127 in order to create the suction or pumping force necessary to draw the melted metal, preferably in the liquid state, from the melt furnace 125 into the feeder 105. In this aspect of the present invention, the melt furnace 125 may be located below or level with the feeder 105. The suction of the pump is sufficient to draw the melted metal upwards through the conduit 127. However, the melt furnace 125 may be located above the feeder 105, as illustrated in FIG. 2, if desired. In this case, the melted metal 111 is drawn into the feeder 105 by suction from the pump 131 and/or by the force of gravity. Furthermore, the conduit 127 may be located on the side of the feeder 105, above or below the melted metal 111 fill line or on the top of the feeder 105.

The pump 131 may operate continuously or intermittently. For example, the pump 131 may be turned on by a controller, such as a computer or a microprocessor, when a level sensor in the feeder 105 indicates that the level of melted metal 111 in the feeder 105 needs replenishing. Alternatively, the pump 131 may be activated with each injection stroke of the first piston 119 to replenish the supply of melted metal 111 in the feeder 105 after each injection stroke.

3. The Second Piston 133

According to a third preferred embodiment of the present invention, the melted metal 111 is injected into the feeder 105 from the melt furnace 125. In a preferred aspect of the third preferred embodiment, a second piston 133 is used to inject the melted metal 111, preferably in a liquid state, into the feeder 105. The second piston may have a "T" shaped illustrated in FIG. 5, or it may have any other desired shape, such as the thick rod shape of the first piston 119.

Figure 5:
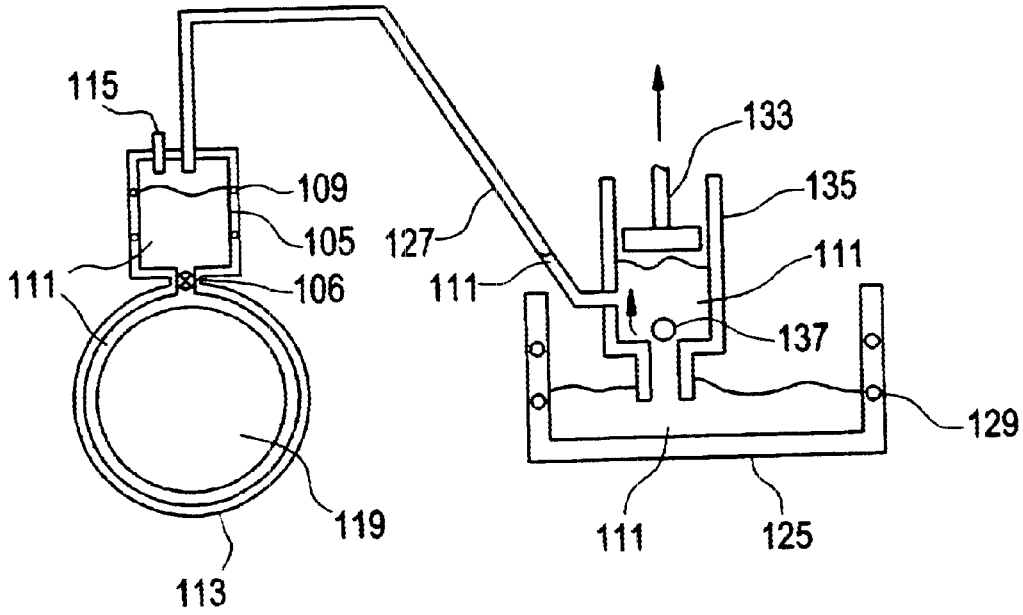
FIGS. 5 and 6 are schematic illustrations of a back cross sectional view of the injection molding system according to one aspect of a third preferred embodiment of the present invention.

As illustrated in FIG. 5, the second piston 133 is preferably located in a temporary holding chamber 135, which is preferably separated from the melt furnace 125 by a check valve 137. The valve 137 may be a spring mounted ball valve, as illustrated in FIG. 5, or a mechanical valve which is operated by a computer or another similar controller, which times the opening and closing of the valve with the upward and downward strokes of the second piston 133. The spring (not shown) of the ball valve 137 may fixed such that the default position of the ball valve 137 is either an open or closed position, as desired.

The second piston 133 operates as follows. As illustrated in FIG. 5, the second piston 133 is first moved away from the inlet to the melt furnace 125 (i.e., moved upwards as indicated by the arrow) to create a suction in the temporary holding chamber 135. The suction and/or a spring (if set to fix the default valve position to open) raises the ball valve 137. The suction draws the melted metal 111 from the melt furnace 125 into the temporary holding chamber 135.

Figure 7:
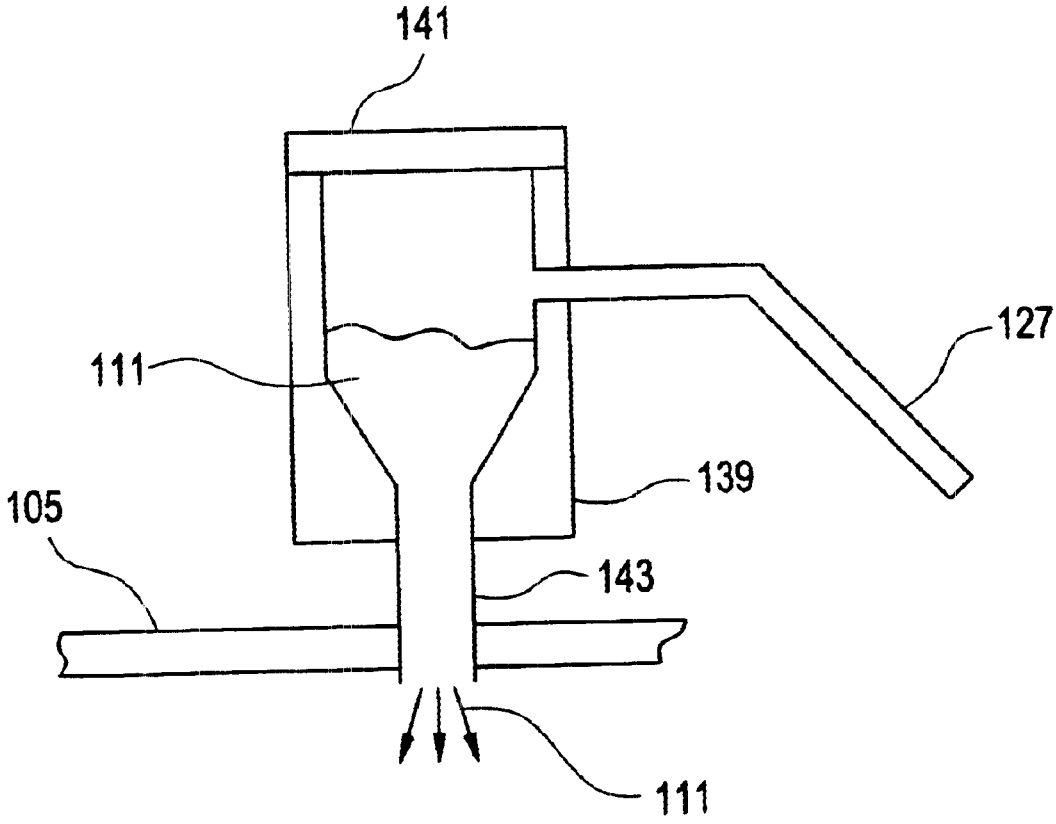
FIG. 7 is a schematic illustration of a side cross sectional view of a portion of the injection molding system according to the third preferred embodiment of the present invention.

After the second piston 133 is fully raised, it is rapidly moved forward to inject the melted metal 111 from the temporary holding chamber 135 through the conduit 127 and the inlet 139 into the melt feeder 105, as illustrated in FIG. 7. The force of the injected melted metal 111 and/or the spring (if set to fix the default valve position to close) forces the ball valve 137 to close the inlet to the temporary holding chamber 135. If a mechanical valve is present instead of the ball valve 137, then a controller times the opening and closing of such valve with the movement of the piston. Preferably, the same motor and controller are used to move the second piston 133 and to open and close the mechanical valve.

The melted metal 111 flows into the feeder 105 through inlet 139 connected to conduit 127. The inlet 139 may comprise a simple pipe or opening extending into the feeder 105. Alternatively, the inlet 139 may comprise an inlet chamber 141 and a metering nozzle 143 as illustrated in FIG. 7. The metering nozzle 143 is preferably a narrow opening which limits the amount of melted metal 111 flowing into the feeder 105. A dose of melted metal 111 is first injected by the second piston 133 into the wider portion of the inlet chamber 141. The melted metal then slowly drips out into the feeder 105 through the nozzle 143 until a subsequent dose of melted metal 111 is injected by the second piston 133. The nozzle 143 prevents the high velocity molten metal 111 injected by the second piston 133 from directly impacting the molten metal 111 already present in the feeder 105. Thus, the nozzle 143 prevents or reduces splashing and plaque buildup in the feeder 105.

Figure 6:
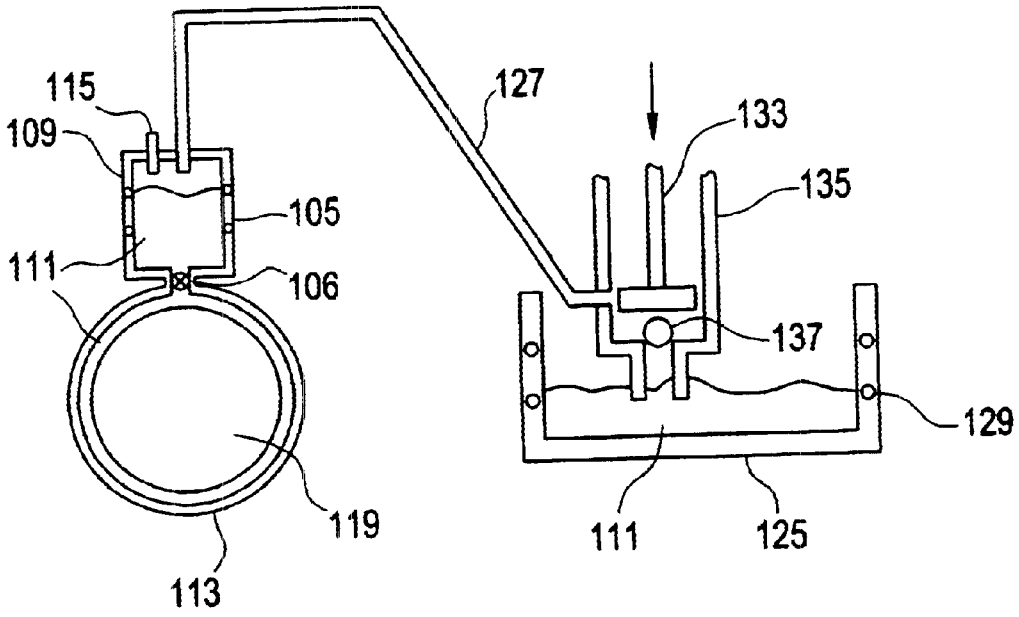

As illustrated in FIGS. 5 and 6, the second piston 133 alone is used to transfer the melted metal 111 into the feeder 105. Alternatively, the second piston 133 may be supplemented and/or replaced by a pump located in communication with the conduit 127 and/or the temporary holding chamber 135, if desired. Furthermore, while the melt furnace 125 is illustrated in FIGS. 5 and 6 as being located below the feeder 105, the melt furnace 125 may be located above (or level with) the feeder such that gravity assists in forcing the melted metal 111 into the feeder 105, if desired.

Figure 8:
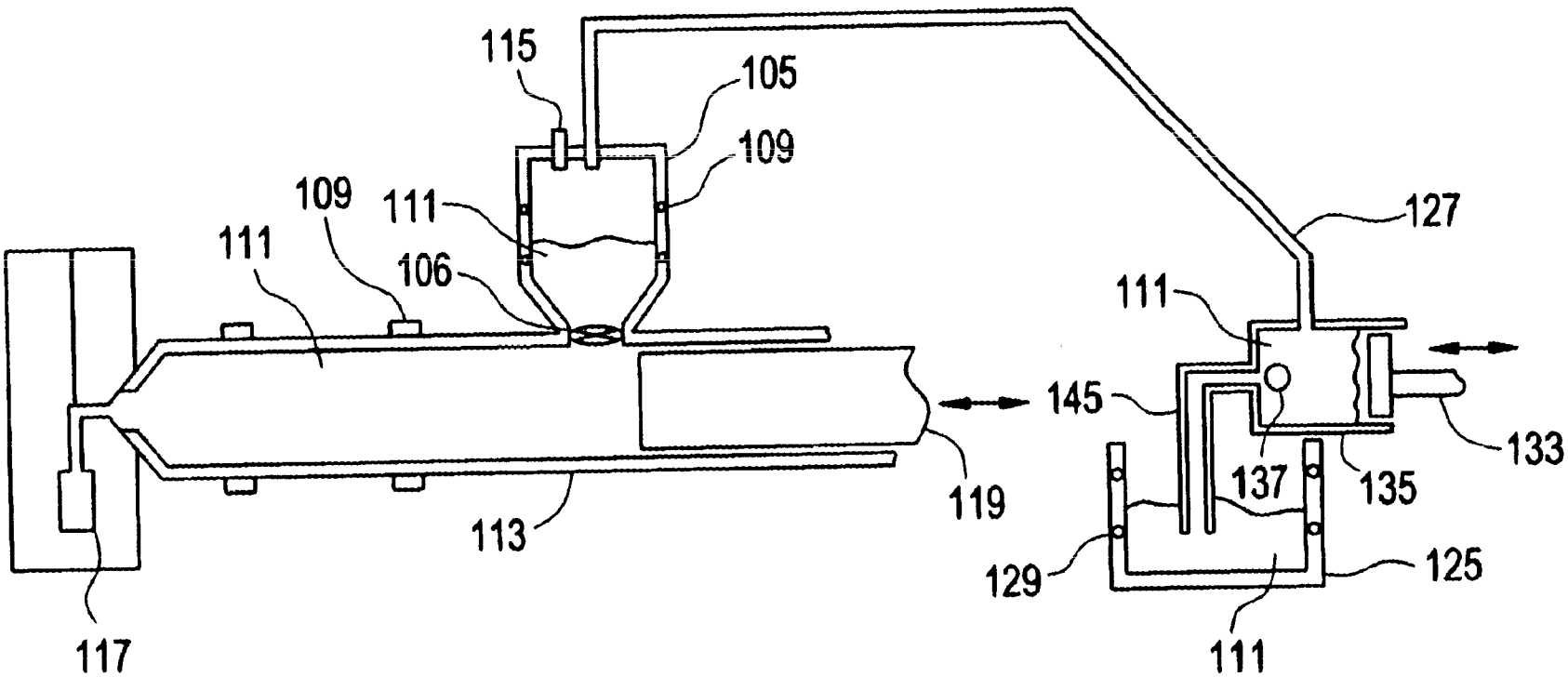
FIGS. 8 and 9 are schematic illustrations of a side cross sectional view of the injection molding system according to alternative aspects of the third preferred embodiment of the present invention.

The temporary holding chamber 135 is illustrated as being vertical in FIGS. 5–6. However, the temporary holding chamber 135 may be positioned inclined at any angle. For example, as illustrated in FIG. 8, the temporary holding chamber 135 is placed horizontally. The second piston 133 in this case also moves horizontally, and the melted metal 111 enters the temporary holding chamber 135 through a temporary holding chamber inlet 145.

Figure 9:
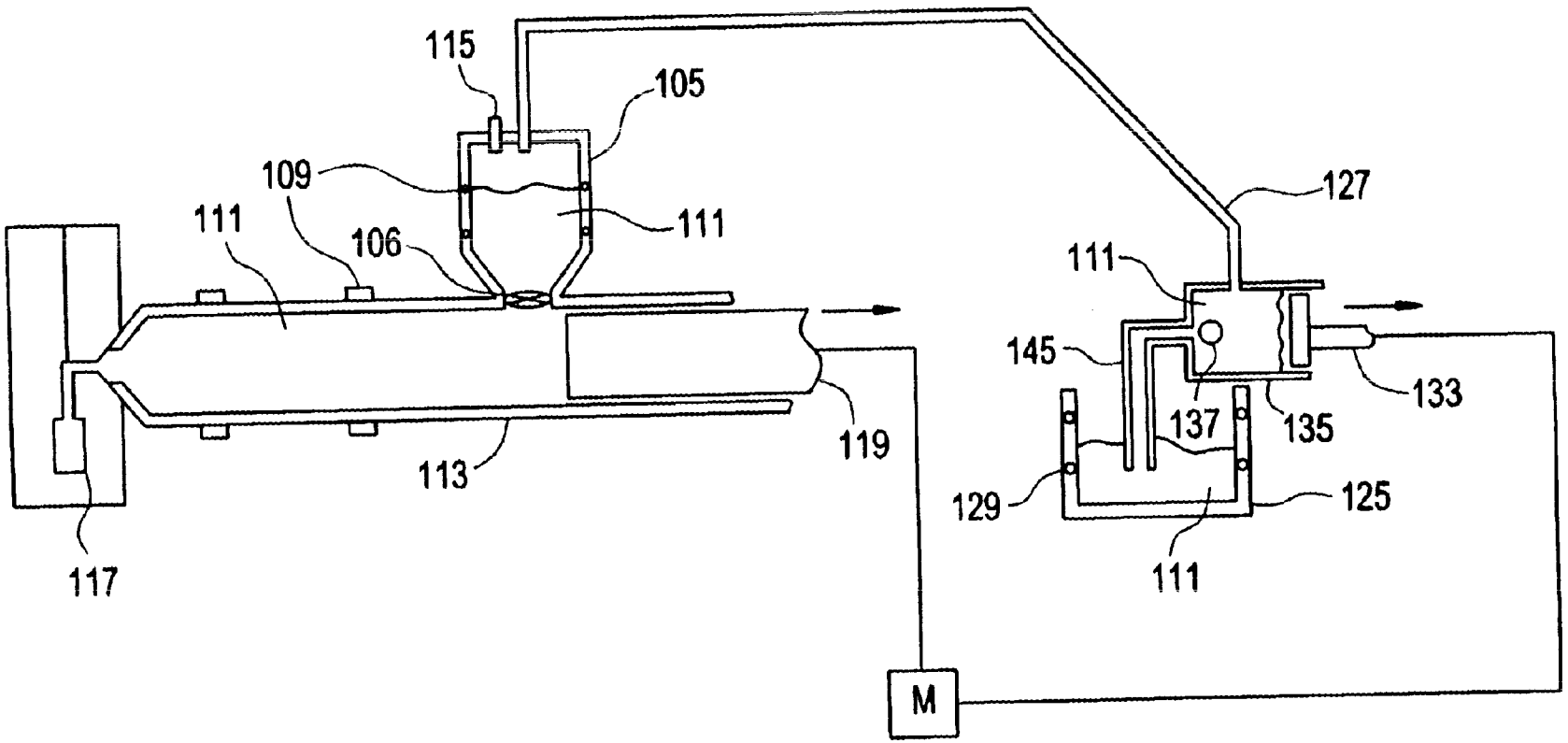

This arrangement is advantageous if the injection chamber 113 is also located horizontally. Thus, both the first piston 119 and the second piston 133 move parallel to each other, as illustrated by the arrows in FIG. 8. Thus, if desired, both pistons 119, 133 may be actuated by the same motor 147 and the injection and suction strokes of both pistons 119, 133 are synchronized because they correspond the same impulse generated by the motor 147, as shown in FIG. 9. The injection process is simplified because a separate motor and/or a separate set of control instructions are not necessary to actuate the movement of the second piston 133.

If the injection chamber 113 is positioned vertically, then it is preferable to also position the temporary holding chamber 135 vertically as shown in FIGS. 5–6 in order to actuate both pistons 119, 133 in the same direction with the same motor 147. However, the first and second pistons may move in perpendicular directions, actuated by the same motor 147, when the injection chamber 113 and temporary holding chamber 135 are positioned perpendicular to each other (i.e., one is vertical and the other is horizontal).

4. The Melt Furnace Support

Figure 10:
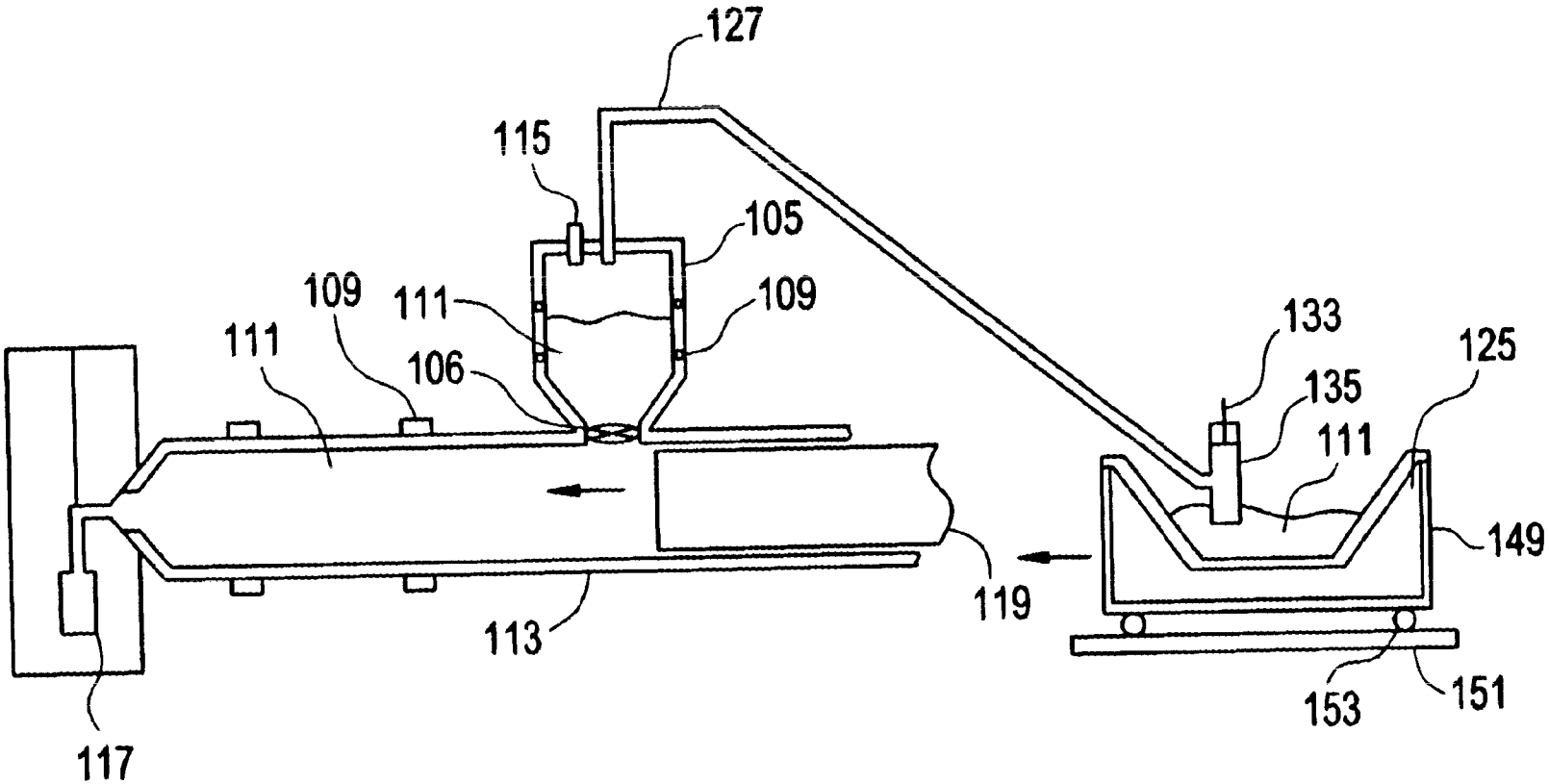
FIGS. 10, 11 and 13 are schematic illustrations of a side cross sectional view of preferred mounting configurations of the melt furnace of the injection molding system of the preferred embodiments of the present invention.

The melt furnace 125 is preferably mounted in a frame 149, as illustrated in FIG. 10. The melt furnace 125 is illustrated as being located behind the injection chamber 113 for clarity. However, the melt furnace 125 may be located along the side, in front, below and/or above the injection chamber 113, as desired.

The injection chamber 113 and the feeder 105 may be slidably mounted, such as on bearings, wheels and/or rail(s), to allow for forward movement of the injection chamber during the forward stroke of the first piston 119. In a fourth preferred embodiment of the present invention, the frame 149 may also be slidably mounted on wheels or bearings 153 that slide back and forth on a rail or in a groove 151, as illustrated in FIG. 10. Alternatively, the frame 149 may be omitted and the melt furnace 125 may be directly mounted on the wheels or bearings 153. Furthermore, the rail or groove 151 may be omitted, and the wheels or bearings 153 may roll on a flat supporting surface instead. Furthermore, the melt furnace 125 may contain splash guards (not shown) to prevent metal splashing during the movement of the melt furnace 125.

The melt furnace 125 and/or the frame 149 are preferably coupled to the feeder 105 and/or the injection chamber 113 to avoid rupturing the conduit 127 during each forward jump of the feeder/injection chamber with each forward stroke of the first piston 119. Any known coupling scheme may be used. For example, if the conduit 127 is a strong, rigid pipe, then the feeder 105 may be coupled to the melt furnace 125 solely by the conduit 127. Alternatively, if the conduit 127 is flexible or not sufficiently strong, then the feeder 105 and/or the injection chamber 113 may be coupled to the melt furnace 125 and/or the frame 149 by a coupling element(s), such as a rigid bar, a chain or a metal wire. The melt furnace 125 and/or the frame 149 coupled to the feeder 105 and/or the injection chamber 113 move in tandem with each forward stroke of the first piston 119.

Figure 12:
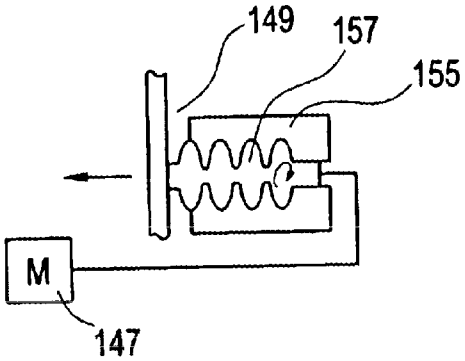
FIG. 12 is a schematic illustration of a side cross sectional view of a referred drive actuator for mounting configurations of FIGS. 10 and 11.
Figure 11:
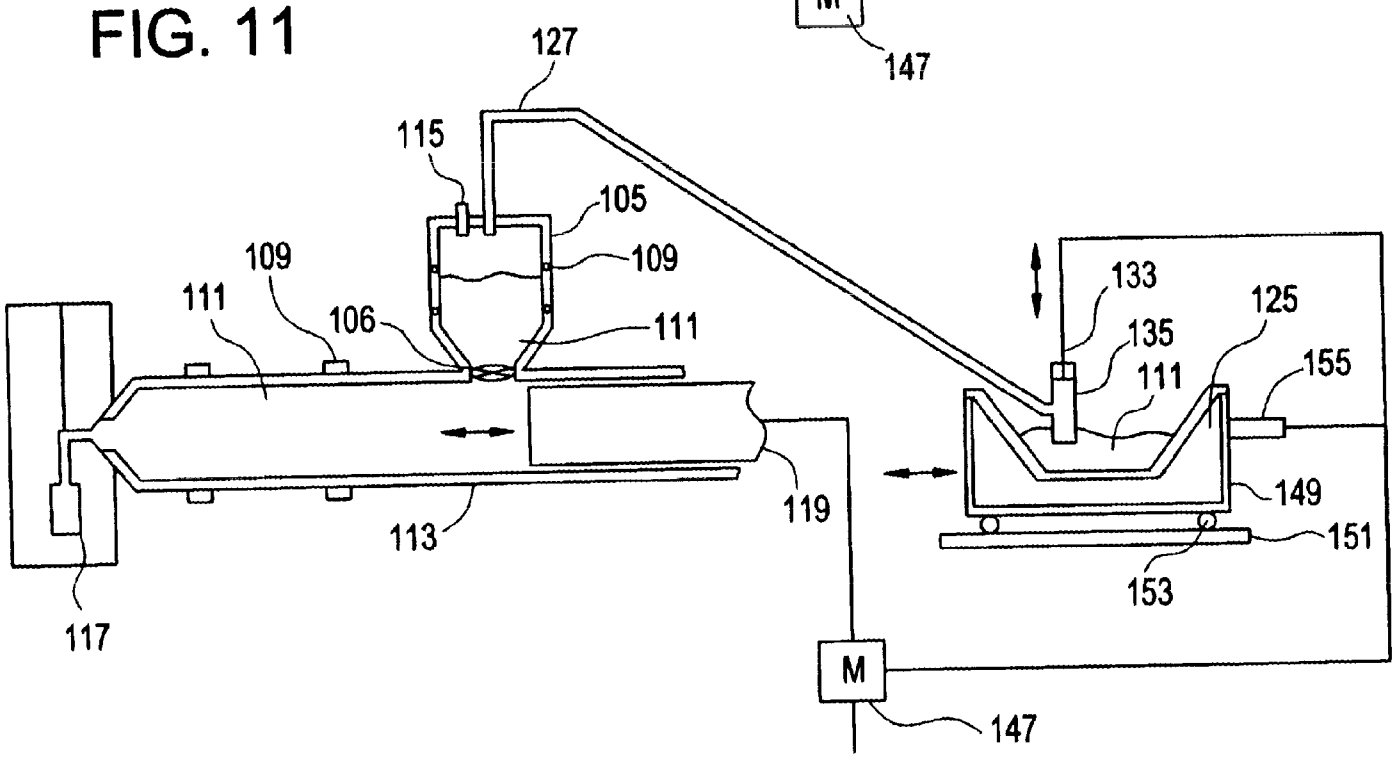

In a preferred aspect of the present invention, the melt furnace is coupled to a drive actuator 155, as illustrated in FIG. 11. The drive actuator may be for example, a screw 157, which rotates forward in a thread and exerts a forward force on the frame 149 and/or the melt furnace 125, as illustrated in FIG. 12. Preferably, the same motor 147 actuates the forward movement of the first piston 119 and the drive actuator 155, as illustrated in FIGS. 11 and 12. This allows the melt furnace 125 and/or the frame 149 to move forward with each forward stroke of the first piston 119 (and thus each forward jump of the injection chamber 113 and feeder 105) without using a separate motor or a separate controller. However, the drive actuator 155 may be actuated by a different motor and/or controller than the first piston 119, if desired.

Figure 24:
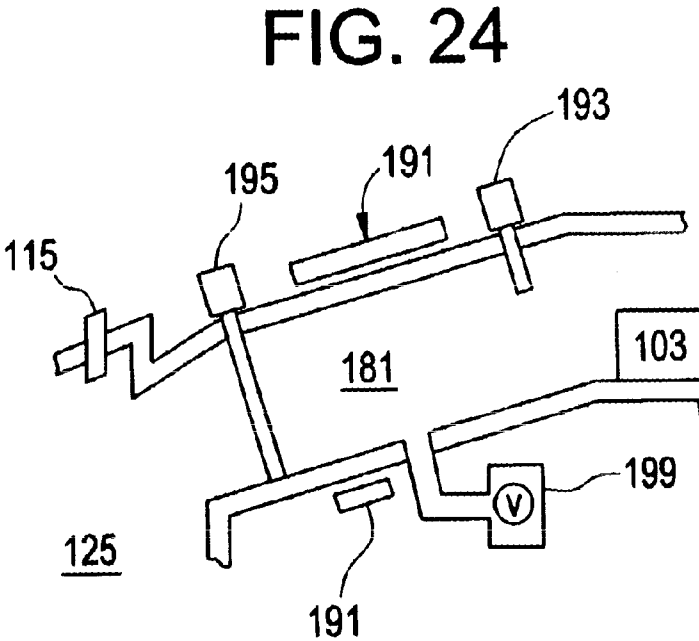
FIGS. 24 and 25 are schematic illustrations of a side cross sectional view of alternative aspects of the delivery system illustrated in FIG. 23.

In another preferred aspect of the present invention, the second piston 133 is actuated by the same motor 147 and/or controller as the drive actuator 155 in order to simplify the injection molding process. In yet another preferred aspect of the present invention, the same motor 147 and/or controller is used to actuate the first piston 119, the second piston 133 and the drive actuator 155 in order to further simplify the injection molding process. In this aspect, the first piston 119, the second piston 133 and the melt furnace 125 and/or frame 149 are synchronized to move forward and backward at the same time, as illustrated in FIG. 11. However, first piston 119, the second piston 133 and the drive actuator 155 may be actuated by a different motor and/or controller, if desired. Furthermore, the second piston and chamber 135 may be completely omitted in the fourth and fifth preferred embodiments and suction and/or gravity feeding may be used instead, if desired, as illustrated in FIG. 24.

Figure 13:
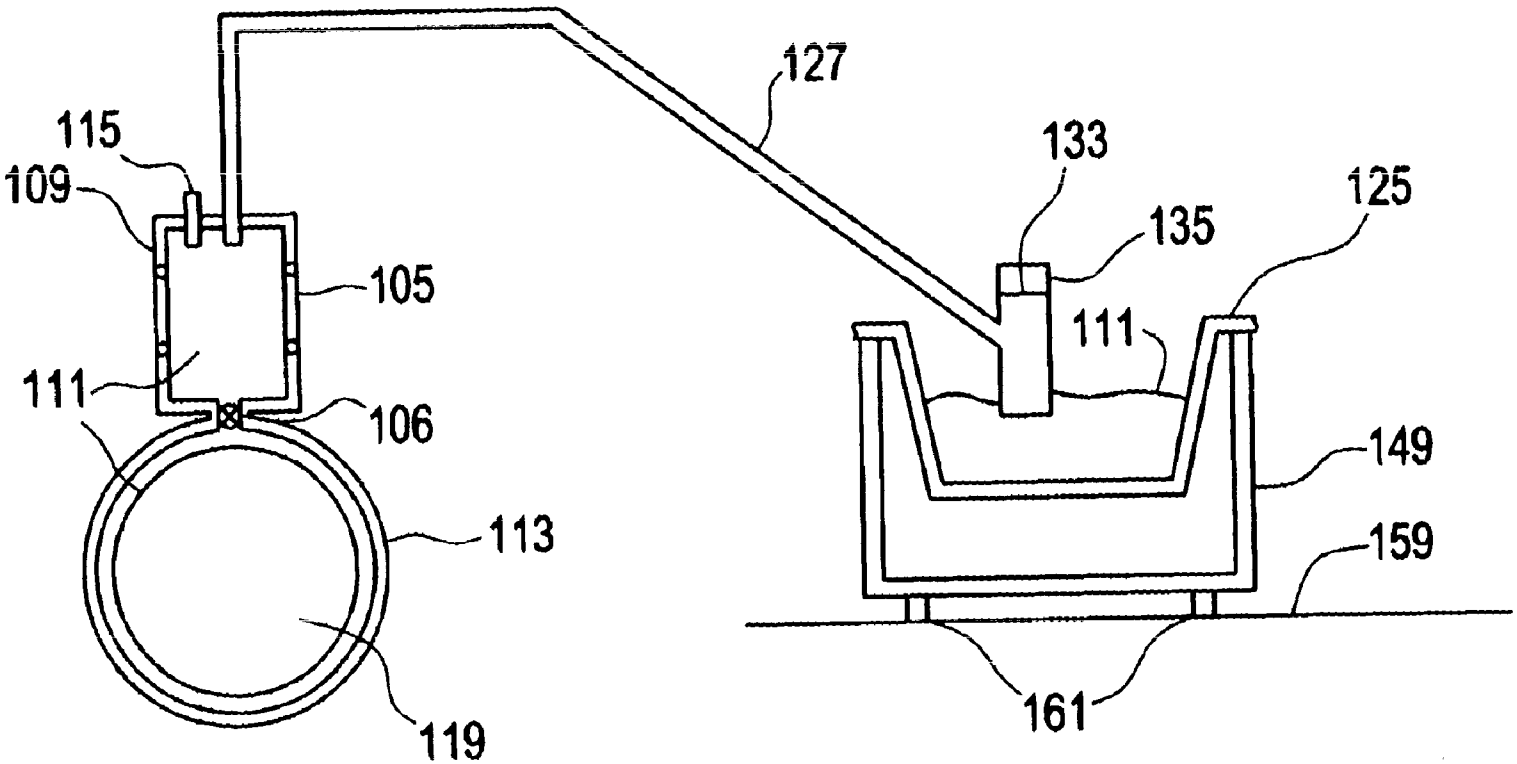

In a fifth preferred embodiment of the present invention, the melt furnace 125 and/or the frame 149 are rigidly mounted to a supporting surface. For example, the frame 149 may be rigidly mounted to the supporting surface 159 by mounting element(s) 161, such as bolts, rigid bars or welds, as illustrated in FIG. 13. Rigid mounting decreases metal splashing from the melt furnace 125 because the melt furnace does not move during an injection stroke. Alternatively, the frame 149 may be omitted, and the melt furnace 125 may be directly mounted on the support surface 159. Furthermore, the temporary support chamber 135 may be rigidly mounted to the support surface 159 or slidably mounted to the frame 149 or the support surface 159 to account for the forward stroke of the second piston 133.

5. The Conduit 127

The conduit 127 may comprise any element that can transfer melted metal 111 from the melt furnace 125 to the feeder 105. Preferably, the conduit 127 comprises a pipe or tube of a suitable inner diameter and material. The preferred inner diameter is 25–45 mm, the most preferred inner diameter is 40 mm. The conduit may be made of any temperature resistant and/or corrosion resistant material, such as temperature and/or corrosion resistant iron. The pipe may be a rigid pipe, such as that illustrated in FIGS. 10–11. Alternatively, the conduit 127 may comprise a flexible or a rotatable pipe, especially if the melt furnace 125 and/or frame 149 are rigidly mounted to the support surface as illustrated in FIG. 13. However, the flexible or rotatable pipe may also be used in the fourth preferred embodiment illustrated in FIGS. 10–11. The conduit is connected to the melt furnace 125 in the first and second preferred embodiments (FIGS. 24) or to the temporary holding chamber 135 in the third preferred embodiment (FIGS. 5–9). Thus, while the following discussion is directed to the flexible or rotatable mounting of the conduit 127 to the melt furnace 125, the conduit may actually be mounted to the temporary holding chamber 135, if present.

Figure 15:
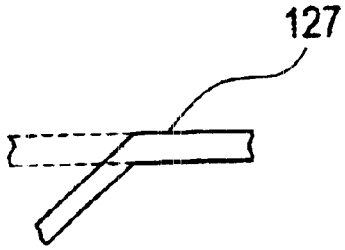
FIGS. 15, 17, 19 and 20 are schematic illustrations of close up side views of the three preferred conduits illustrated in FIGS. 14, 16 and 18.
Figure 14:
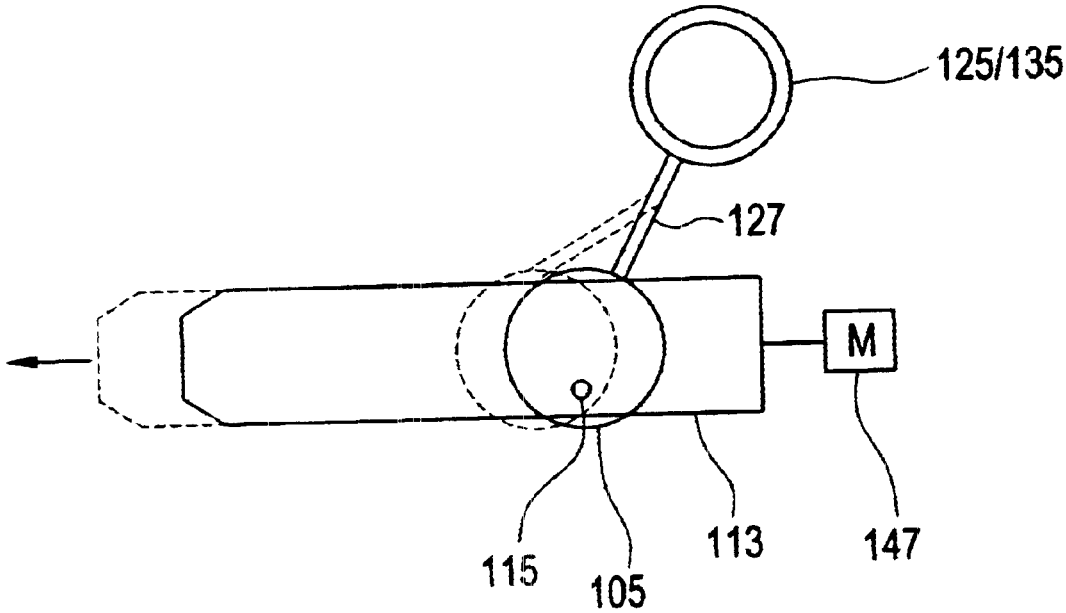
FIGS. 14, 16 and 18 are schematic illustrations of a top view of three referred conduits connecting the melt furnace and the feeder.

FIGS. 14 and 15 illustrate a flexible conduit 127 according to the sixth preferred embodiment of the present invention. The flexible conduit comprises a pipe that bends sideways upon the application of a stress. For example, as illustrated in FIG. 14, when the injection chamber 113 and the feeder 105 move forward (illustrated with dashed lines) with each forward stroke of the first piston 119, the melt furnace 125 and the frame 149 remain stationary. The disparate movement of the elements connected by the conduit 127 places a tensile stress on the conduit 127. However, since the conduit 127 is bendable, it bends sideways, as illustrated in FIGS. 14 and 15.

Figure 17:
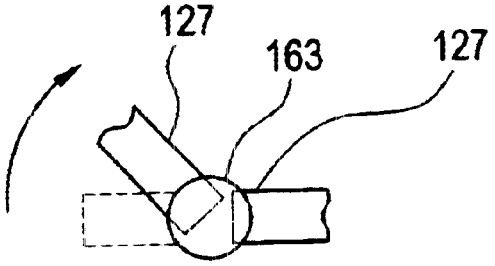
Figure 16:
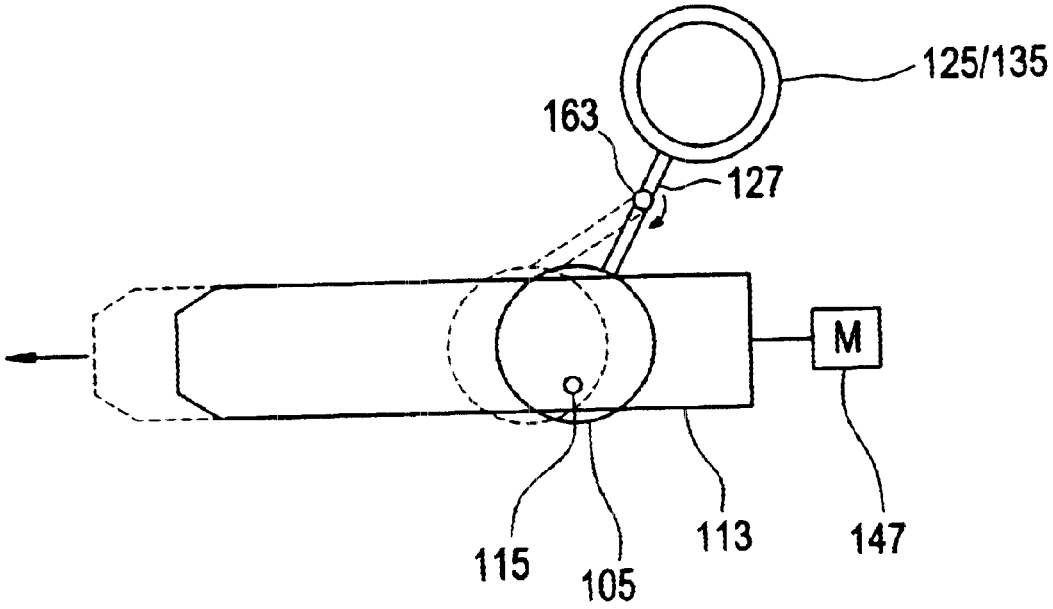

Alternatively, the conduit 127 may comprise a rotatable pipe according to a seventh preferred embodiment of the present invention. Any elements that impart rotational movement to the conduit 127 may be used. In one aspect of the seventh preferred embodiment, the conduit 127 may comprise two pipe portions joined by a swivel elbow 163, as illustrated in FIGS. 16 and 17. The swivel elbow 163 may comprise a rotatable joint attached to ends of both pipe portions.

Figure 20:
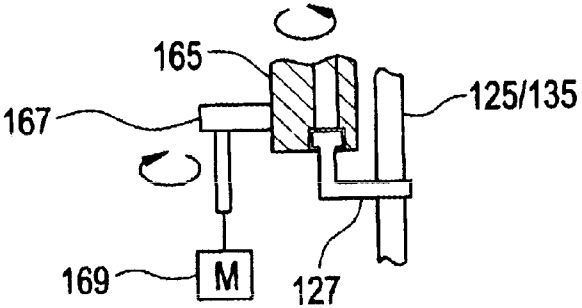
Figure 19:
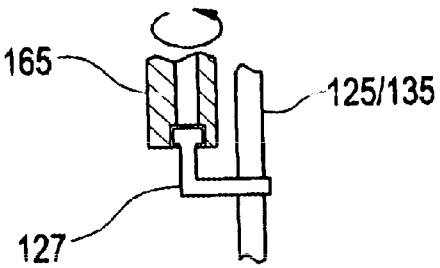
Figure 18:
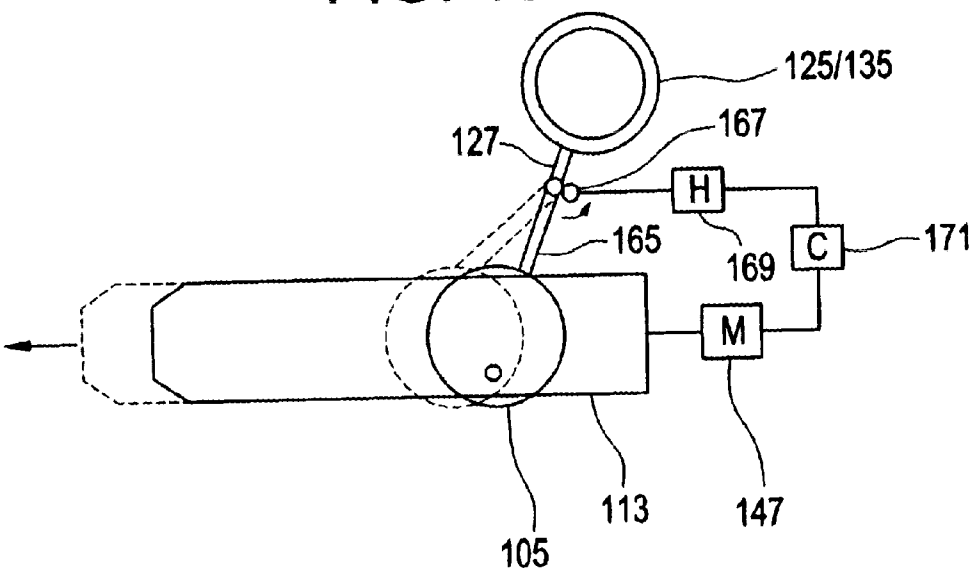

In another aspect of the seventh preferred embodiment, the conduit 127 may be joined to a rotatable conduit portion 165, as illustrated in FIGS. 18–20. For example, the rotatable conduit portion 165 may comprise a pipe having a diameter that is greater than or less than that of pipe portion 127 in FIG. 19. When slidably mounted over or into the pipe 127, the rotatable pipe portion 165 may swivel around its axis, as illustrated in FIG. 19. The slidable mounting may comprise low friction mounting or ball bearing mounting (i.e., ball bearings may be placed between the pipe portions 127 and 165 to enhance the axial rotation of pipe portion 165). Alternatively a motor driven gear 167 may be used to rotate the rotatable conduit portion 165, as illustrated in FIG. 20. The rotation of the gear 167 forces the conduit portion 165 to rotate in the opposite direction, as illustrated by the arrows in FIG. 20. The gear 167 may be driven by a separate motor 169, which is synchronized by a controller 171 to the movement of the first piston 119, as illustrated in FIG. 18, or by the same motor 147 used to drive the piston 119. Furthermore, the gear 167 may be used to rotate the swivel elbow 163 illustrated in FIGS. 16–17 instead of the pipe portion 165 illustrated in FIG. 20.

For example, as illustrated in FIGS. 16 and 18, when the injection chamber 113 and the feeder 105 move forward (illustrated with dashed lines) with each forward stroke of the first piston 119 around a circumference of an imaginary circle with a center at the melt furnace 125, the melt furnace 125 and/or the frame 149 remain stationary. The disparate movement of the elements connected by the conduit 127 places a tensile stress on the conduit 127. However, since the conduit 127 is rotationally flexible or rotatable, it rotates without tearing or rupturing, as illustrated in FIGS. 16 and 18.

Alternatively, instead of portions of the conduit 127 rotating with respect to each other as described above, the entire conduit 127 may rotate around the melt furnace 125. For example, the conduit 127 may be attached to a rotatable band around the melt furnace 125 and/or the frame 149. Alternatively, the melt furnace 125 may rotate about its center point in the frame 149 or the frame 149 may be rotatably mounted to the support surface to rotatably mount the conduit 127 to prevent its rupture with the movement of the feeder 105 and the injection chamber 113.

If desired, the conduit 127 may be both flexible as illustrated in FIGS. 14–15 and rotatable, as illustrated in FIGS. 16–20. Furthermore, the use of a flexible or rotatable conduit has been described below with the use of a stationary (rigidly mounted) melting furnace 125. However, the flexible or rotatable conduit may also be used with the slidably mounted melting furnace 125 illustrated in FIGS. 10 and 11.

6. The Ingot Delivery System

Figure 21:
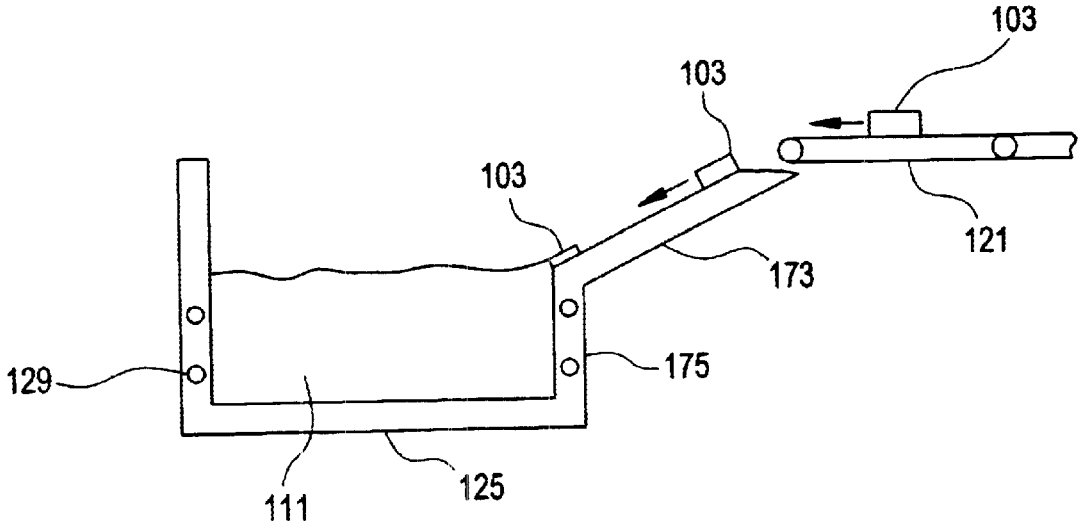
FIG. 21 is a schematic illustration of a side cross sectional view of a delivery system according to one aspect of the present invention.

In order to further minimize splashing and plaque formation in the melt furnace 125, the melt furnace may optionally contain a downward sloping ingot or pellet delivery surface 173, according to one preferred aspect of the present invention illustrated in FIG. 21. For example, the ingots or pellets 103 delivered by a delivery system, such as a conveyor 121 or an elevator, are placed directly on the downward sloping surface 173, and gently slide into the melted metal 111 present the melt furnace 125 under the force of gravity without substantial splashing. The surface 173 may be inclined at an angle of 10–80 degrees with respect to the side wall 175 of the melt furnace 125. The melted metal 111 fill line may be above, at or below the point where the side wall 175 and sloping surface 173 come in contact.

7. The Preheating Chamber

Figure 22:
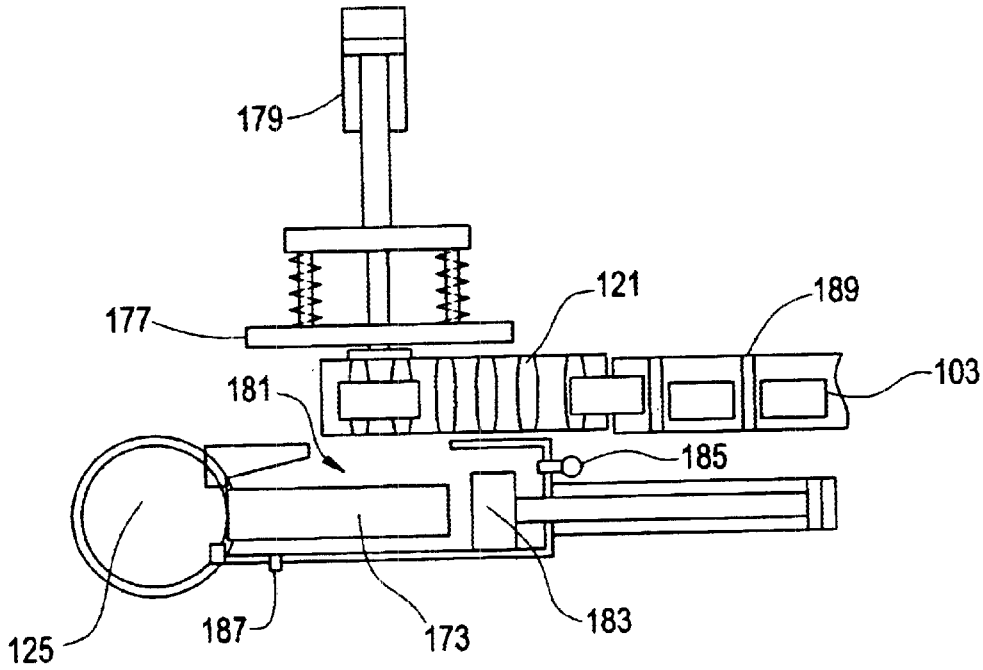
FIG. 22 is a schematic illustration of a top cross sectional view of a delivery system according to another aspect of the present invention.

An example of a delivery system according to another preferred aspect of the present invention is illustrated in FIG. 22. While the delivery system of this aspect may be used to deliver metal pellets, preferably the system of this aspect is used to deliver metal ingots. The ingots 103 are delivered toward the melt furnace 125 on a first conveyor belt 121. A push arm 177 controlled by a conventional motor 179 pushes the ingots 103 into an ingot holding or preheating chamber 181. The push arm has a size sufficient to completely cover the opening to the holding chamber. The push arm 177 can form an air tight seal with the opening into the holding chamber 181, if desired. The ingots 103 inside the holding chamber 181 end up on a downward sloping surface (e.g. inclined surface) 173. The ingots 103 then either slide into the melt furnace 125 under the force of gravity, or a third motor controlled piston 183 pushes the ingots 103 into the melt furnace 125.

The holding chamber is preferably maintained under an inert, protective gas ambient, supplied from one or more gas ports or inlets 185. The gas may be argon, nitrogen, sulfur hexafluoride, carbon dioxide or a mixture of these gasses. The gas pressure in the holding chamber 181 should preferably be maintained at a pressure above one atmosphere to prevent outside air, which contains oxygen, from reaching the melt furnace 125. The gas pressure and/or the position of the ingots may be monitored by one or more sensors 187. The controlled atmosphere in the holding chamber 181 allows a decreased amount of air in the melt furnace 125 and the feeder 105 and thus decreases a chance of explosion.

Furthermore, the holding chamber 181 may be heated by one or more heaters to 100–200° C. to evaporate the moisture from the ingots 103 before they enter the melt furnace 125. The delivery system may also contain a second conveyor belt 189 in addition to the first conveyor belt 121 described above, to deliver the ingots 103 from an input source, such as an elevator to the first conveyor 121.

Figure 23:
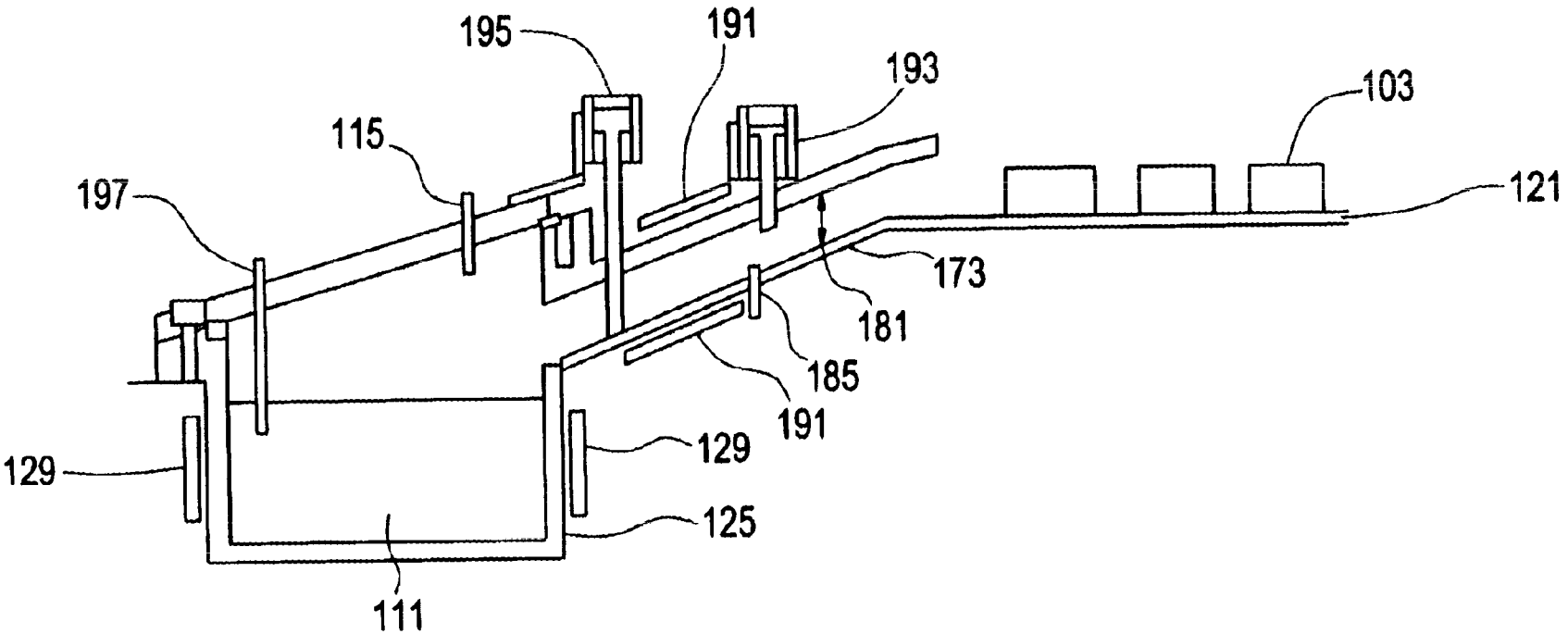
FIG. 23 is a schematic illustration of a side cross sectional view of a delivery system according to another aspect of the present invention.

FIG. 23 shows a side view of a loading system according to another preferred aspect of the present invention. While the delivery system of this aspect may be used to deliver metal pellets, preferably the system of this aspect is also used to deliver metal ingots. The ingots 103 are transported on a conveyor 121 to an ingot holding or preheating chamber 181, which may contain the downward sloping surface 173, if desired. Alternatively, downward sloping surface 173 may be omitted and the conveyor 121 may stretch through the holding chamber 181 all the way to the entrance to the melt furnace 125. Furthermore, the conveyor 121 may also be downwardly sloped in the holding chamber 181. The chamber 181 may be heated by heaters 191 to 100–200° C. to evaporate moisture on the surface of the ingots 103, if desired.

The melt furnace 125 may contain a melted metal level sensor 197, if desired. The sensor 197 is connected to a controller which starts and stops the conveyor 121 and/or other delivery system elements depending on the level of the melted metal 111 in the melt furnace. The conduit 127 is omitted from FIG. 23 for clarity.

If desired, the melt furnace 125 and/or the holding chamber 181 may also contain a protective gas port(s) or inlet(s) 115, 185 respectively. The inert, protective inert gas, such as at least one gas selected from a group comprising nitrogen, argon, $SF_6$ and $CO_2$, may be introduced under pressure from a pressurized tank. The gas pressure of the pumped gas is preferably above one atmosphere to keep air from entering the melt furnace 125 through holding chamber 181.

Access to the holding chamber 181 is preferably controlled by a first door 193. Egress from the holding chamber is preferably controlled by a second door 195. The holding chamber 181 operates as follows. First, door 193 is opened as ingot 103 approaches it. Door 193 can preferably be opened by moving up, down or sideways through the walls of chamber 181, or in or out of the chamber 181. The first door 193 is closed as the ingot 103 enters the chamber 181. After the first door 193 is closed, the second door 195 is opened and the ingot 103 moves out of chamber 181 and into the melt furnace 125. The conveyor 121 can move continuously up to or through chamber 181 with doors 193 and 195 opened and closed while the conveyor is moving. Alternatively, the conveyor 121 moves intermittently. It stops when an ingot approaches door 193 and when the ingot 103 is inside the chamber 181. This allows the doors 193, 195 to be sealed hermetically.

In another alternative aspect of the invention, the loading system shown in FIG. 22 can be used with door 193 of FIG. 23 positioned between conveyor 121 and chamber 181 and/or with door 195 of FIG. 23 positioned between the chamber 181 and the melt furnace 125. Door 193 opens synchronously with the movement of the push arm 177, while door 195 opens synchronously with the movement of the piston 183.

In another aspect of the present invention, a vacuum pump 199, shown in FIG. 24 may be placed in communication with the holding chamber 181, between doors 193 and 195. As the ingot 103 enters chamber 181, both doors 193, 195 are closed and the vacuum pump 199 creates a near vacuum in chamber 181. Door 195 is then opened to release ingot 103 into melt furnace 125 without allowing substantially any air to enter melt furnace 125 because chamber 181 was at near vacuum when door 195 is opened. Furthermore, if desired, pump 199 may be omitted and a single vacuum pump 131, illustrated in FIG. 4, may be placed in communication with both the conduit 127 and the holding chamber 181.

Figure 25:
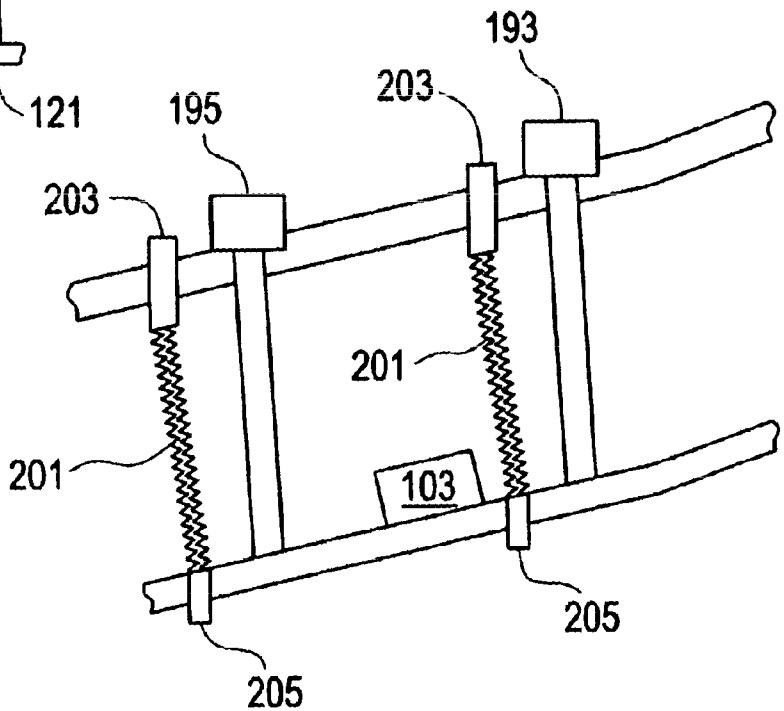

In another aspect of the present invention, at least one inert gas screen 201 can be made to flow from inert gas source(s) 203 across chamber 181 into an inert gas outlet 205, such as a suction pipe or vent, as shown in FIG. 25. The inert gas screen(s) 201 keep air from entering the holding chamber 181 and the melt furnace 125. The inert gas can comprise at least on gas selected from a group comprising argon, nitrogen, $CO_2$ and $SF_6$. The screen(s) 201 may be located in the middle of chamber 181 or in front or behind one or both doors 193, 195. The preferred location of the screens 201 is illustrated in FIG. 25.

The inert gas screen(s) 201 of FIG. 25 may be used in combination with vacuum pump 199 of FIG. 24 to further decrease the amount of air penetrating into melt furnace 125. Other air control measures, such as the protective gas inlets 115, 185, doors 193, 195, vacuum pump 199 and inert gas screen(s) 201 may all be used together to even further decrease the amount of air penetrating into melt furnace 125 to reduce the possibility of explosion.

8. Cover Plates 207, 213

Figure 26:
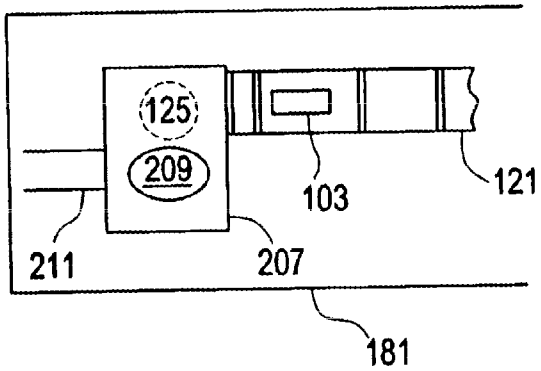
Figure 27:
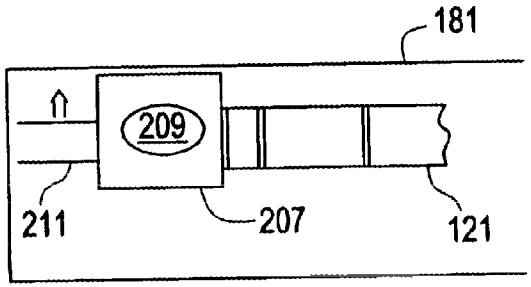

FIGS. 26 and 27 show another alternative aspect of the present invention. In this aspect, a movable aperture plate 207 is located over the entrance to the melt furnace 125. The plate 207 may be located between the melt furnace 125 and the conveyor 121 of FIGS. 2, 21 or between the melt furnace 125 and the holding chamber 181 of FIGS. 22–23.

FIG. 26 shows a top view of the delivery system where the access to the melt furnace 125 is closed. The movable aperture plate 207 contains an aperture 209 which is larger than an ingot 103. When no more ingots should be added to the melt furnace 125, the plate 207 is moved to one side by a moving element, such as a movable arm 211, etc, such that the plate 207 covers the entrance or opening to the melt furnace 125. In this position, the aperture plate 207 thus blocks the entrance of air into the melt furnace 125.

As shown in FIG. 27, when it is desired to add additional ingots 103 into the melt furnace 125, the plate 207 is moved such that the aperture 209 corresponds to the opening to the melt furnace 125. The ingot(s) 103 coming off the conveyor 121 or sloped surface 173 pass through the aperture 209 into the melt furnace 125.

Figure 28:
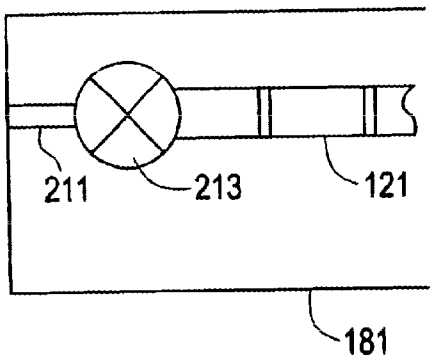
FIGS. 26–29 are schematic illustrations of a top view of delivery systems according to alternative aspects of the present invention.
Figure 29:
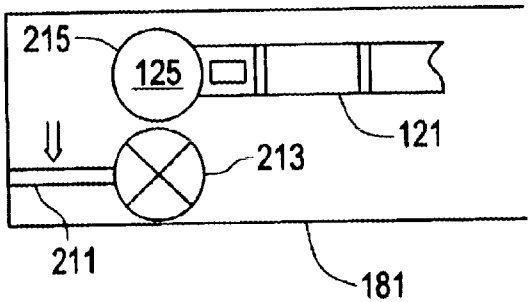

FIGS. 28 and 29 show an alternative delivery system to that shown in FIGS. 26 and 27. As illustrated in FIG. 28, the system utilizes a movable cover plate 213 instead of a movable aperture plate 207. The cover plate 213 may have any shape which is sufficient to cover the opening 215 to the melt furnace 125. For example, the plate 213 may have a circular shape if the opening 215 to the melt furnace 125 is also circular.

FIG. 28 shows a top view of the delivery system where the entrance to the melt furnace 125 is closed. A moving element, such as a movable arm 211, moves the cover plate 213 over the opening to the melt furnace 125 to block access of air and ingots 103 coming off the conveyor 121 or sloped surface 173.

As shown in FIG. 29, when it is desired to add additional ingots 103 into the melt furnace 125, the plate 213 is moved or raised up to expose the entrance or opening 215 to the melt furnace 125. The ingots 103 coming off the conveyor 121 or the sloped surface 173 may drop directly into the melt furnace 125 through opening 215.

In the aspect of the invention shown in FIGS. 26–29, the aperture plate 207 or the cover plate 213 is utilized instead of a push arm 177 and piston 183 shown in FIG. 22. However, the aperture plate 207 or the cover plate 213 may be utilized in addition to the push arm 177 and piston 183. In this case, the plate 207 or 213 would block access to ingots 203 sliding down the sloped surface 173. Furthermore, elements 207 or 213, while referred to as plates, may have other shapes, as desired.

9. The Transfer Chamber 217

Figure 30:
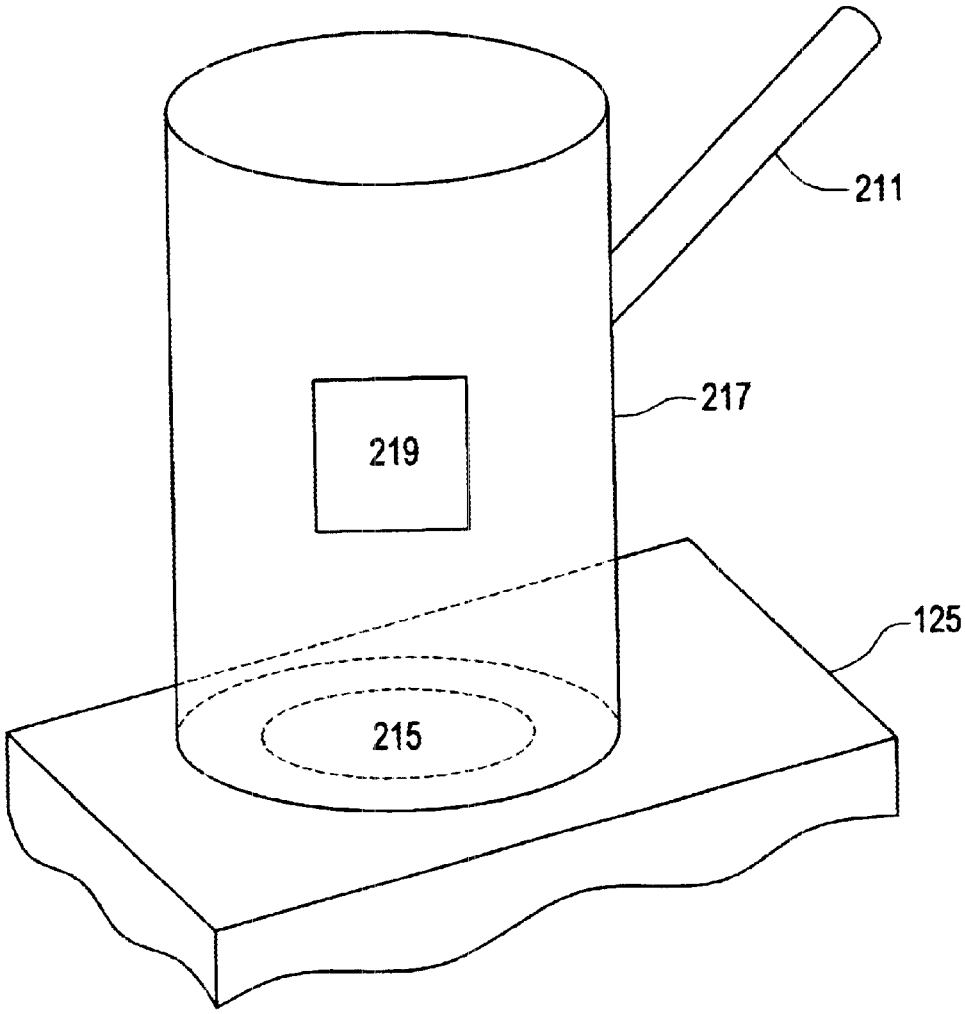
FIG. 30 is a schematic illustration of a side perspective view of a delivery system according to another alternative aspect of the present invention.

FIG. 30 illustrates an alternative delivery system to that shown in FIGS. 26–29. The opening 215 to the melt furnace 125 is covered by a movable transfer chamber 217. The movable transfer chamber may have any desired shape sufficient to cover the opening 215. For example, chamber 217 may have a shape of a cylinder movable by the moving element 211, such as a movable arm or wheels or bearings mounted on a rail or in a groove. Chamber 217 contains an aperture 219. When it is desired to add more ingots (or other forms of solid metal such as pellets) 103 to the melt furnace 125, the moving element 211 positions the chamber 217 such that the aperture 219 lines up with the end of the conveyor 121 or the sloped surface 173. This allows the ingots 103 to be transferred from the conveyor 121 or sloped surface 173 through the aperture 219 into chamber 217 and down into the melt furnace 125 through opening 215. To block access to the melt furnace 125, the moving element 211 moves the chamber 217 in any direction (e.g. up, to the left or to the right) such that the end of the conveyor 121 or sloped surface 173 is no longer aligned with the aperture 219.

An inert protective gas atmosphere may also be maintained in the transfer chamber 217 to decrease the amount of air entering the melt furnace 125. The transfer chamber 217 may also be used with a push arm 177 and piston 183 shown in FIG. 22. In this case, the ingots 103 would slide-down the sloping surface 173 into the transfer chamber 217 instead of dropping directly into the melt furnace 125. The transfer chamber 217 may also be used with the holding chamber 181 of FIGS. 23–25 as illustrated in FIG. 31.

10. The elevator 221

Figure 31:
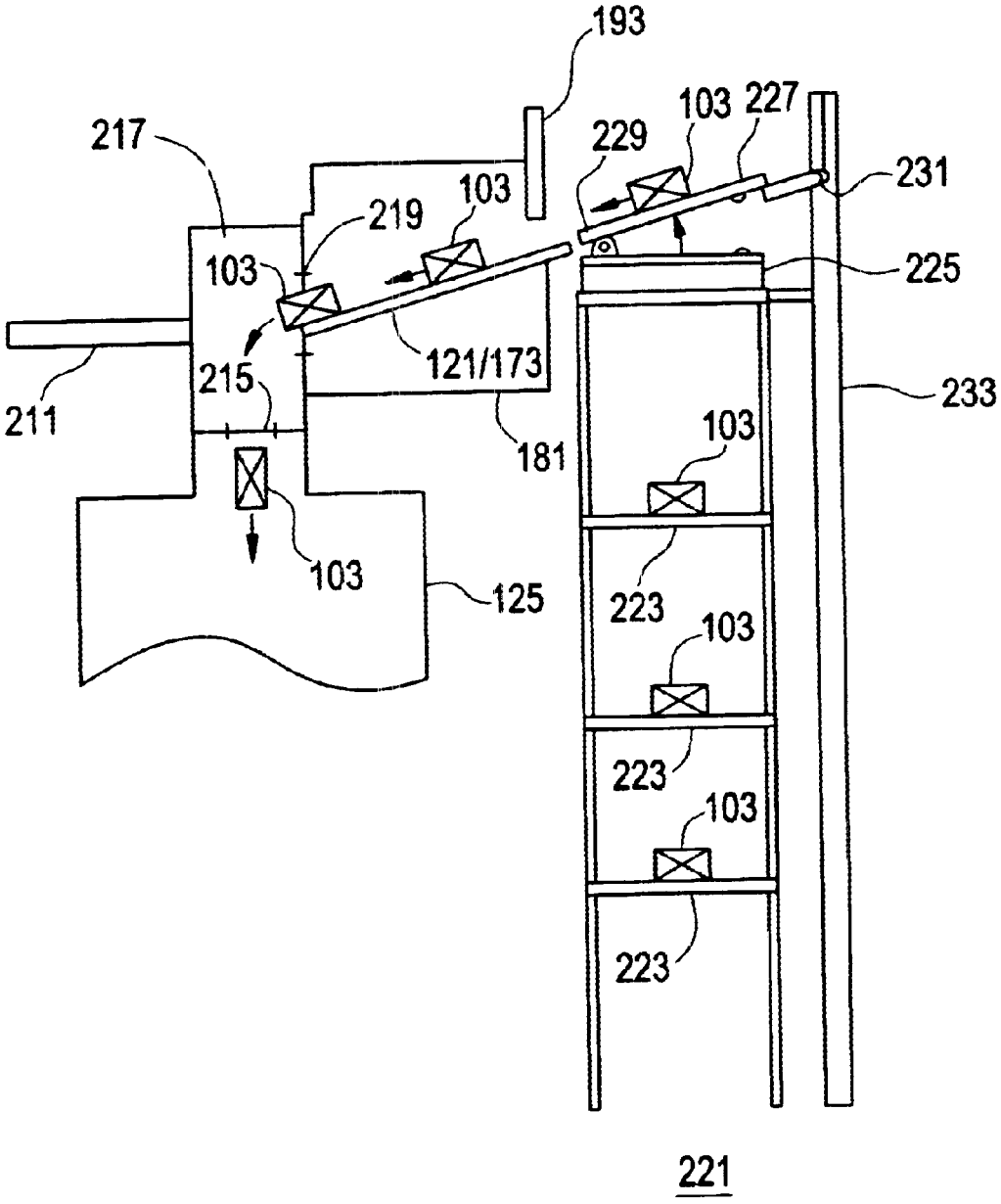
FIG. 31 is a schematic illustration of a side cross sectional view of a delivery system containing an elevator.

FIG. 31 shows an elevator 221 which delivers ingots (or pellets) 103 according to one aspect of the present invention. The elevator contains platforms 223 which raise deliver the ingots 103 toward the melt furnace 125. Each platform 223 comprises a platform base 225 and a movable platform top 227 connected by at least one connector 229. As each platform 223 reaches its top position, a lifting member 231 moves up pole 233 and pushes up on the back end of the platform top 227. The back end of the platform top 227 is lifted above platform base 225 by the lifting member 231, which causes the ingot(s) 103 to slide off the platform top toward the melt furnace 125. Connector 229 may be a bolt or a rod which rotatably connects platform top 227 and base 225. Preferably, the platform top is rotated up about 20 degrees by the lifting member 231. Alternatively, the platform 223 may comprise a unitary member, and the whole platform 223 may be lifted by the lifting member 231.

The elevator 221 may deliver the ingots directly into the melt furnace 125 or it may be used with any other deliver element described above in connection with FIGS. 21–30. For example, the elevator 221 is illustrated in FIG. 31 as being used in conjunction with the holding chamber 181 and the movable transfer chamber 217. However, the elevator 221 may be used with either the holding chamber 181 or the movable transfer chamber 217 alone. Alternatively, the elevator 221 may be used with the aperture plate 207 or cover plate 213 illustrated in FIGS. 26–29, alone or in combination with the holding chamber 181. Furthermore, as illustrated in FIG. 31, the holding chamber 181 contains one door 193 and the conveyor 121 or sloping surface 173. However, the holding chamber may contain other features, such as a push arm 177 and/or piston 183, a protective gas inlet 185, heater(s) 191, a second door 195, a vacuum pump 199 and/or at least one inert gas screen 201, as described above with respect to FIGS. 21–30.

Preferably, the movement of the lifting member 231 is synchronized with the opening of the door(s) 193 and/or 195 by a controller such as a computer or by a human operator. For example, as the lifting member 231 moves up on the pole 233, the door 193 is simultaneously opened to allow an ingot 103 to pass into the holding chamber 181. Furthermore, the aperture or cover plate 207, 213 or the transfer chamber 217 may also be synchronized with the door(s) 193 and/or 195 and/or the lifting member 231. Thus, after the door 193 is closed, the aperture plate 207, the cover plate 213 or the transfer chamber 217 may be moved to open the opening 215 to the melt furnace 125.

The method of operating the elevator 221 illustrated in FIG. 31 will now be described. The elevator platforms 223 raise the ingots 103 to the top of the elevator where the back end of the platform top 227 is lifted above platform base 225 by the lifting member 231. After the ingot(s) 103 are removed from the platform top, the lifting member 231 moves down the pole 233, placing the platform top 227 back onto the platform base 225. The lifting member 231 then disengages the first platform 223, the next platform is moved up, and the process is repeated.

The ingot(s) 103 slide off the lifted platform top 227 onto the conveyor 121 or sloped surface 173. The ingot(s) pass through the holding chamber 181 where they are preferably heated to drive off moisture present on the ingot surfaces. The aperture 219 of the movable transfer chamber 217 is then lined up with the conveyor 121 or sloped surface 173, and the ingot(s) 103 enter the transfer chamber 217 through aperture 219. The ingots then pass from the transfer chamber 217 into the melt furnace 125 through opening 215.

11. The Preferred Barrel and Injection Chamber Injection System

The injection molding apparatus 101 illustrated in FIG. 2 contains a feeder 105 and an injection chamber 113. However, the injection molding apparatus according to the eighth preferred embodiment of the invention also contains a temperature controlled barrel, a ram and other elements described in U.S. Pat. No. 5,983,976, incorporated herein by reference in its entirety.

Figure 32:
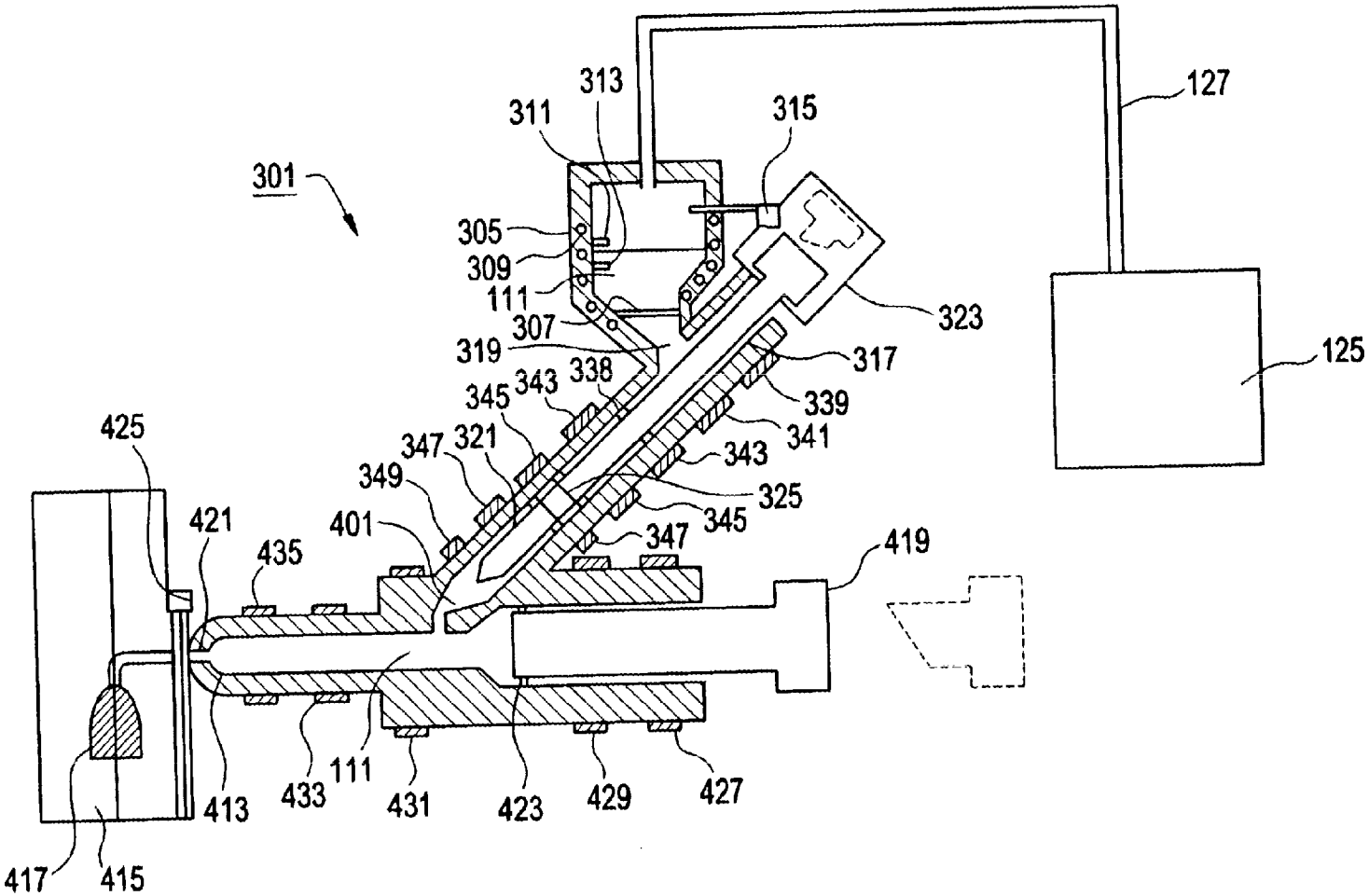
FIG. 32 is a schematic illustration of a side cross sectional view of a preferred injection system containing an injection chamber and a barrel.

The injection molding apparatus 301 according to the eighth preferred embodiment of the present invention is illustrated in FIG. 32. The apparatus contains a feeder 305 which is used to hold melted metal 111. The melted metal 111 is supplied to the feeder 305 through a conduit 127 from a melt furnace 125, schematically illustrated in FIG. 32. The melt furnace 125 and conduit 127 may comprise any melt furnace and conduit described above and illustrated in FIGS. 2–20 above, and which may also include a pump 131, a second piston 133 and any other elements described above. As discussed above, the melt furnace 125 may be located above, below, behind, in front and/or adjacent to a side of the feeder 105. Furthermore, the solid metal ingots or pellets 103 may be supplied to the melt furnace 125 by any delivery system described above and illustrated in FIGS. 2 and 21–31.

The feeder 305 of the eighth preferred embodiment illustrated in FIG. 32 may contain a filter 307, if desired. However, since the melted metal 111 is preferably supplied to the feeder 305 in the liquid state, the filter may be omitted. The feeder 305 is provided with at least one heating element 309 disposed around its outer periphery. The heating element 309 may be of any conventional type and operates to maintain the feeder 305 at a temperature high enough to keep a metal alloy supplied through the feeder 305 in a melted, and preferably liquid state. For a Mg alloy ingot, this temperature would be about 600° C. or greater.

Two level detectors 311, 313 detect minimum and maximum levels of melted metal 111 in the feeder 305. When the upper level detector 311 detects that the level of melted metal 111 has risen to a maximum point, it relays a signal to a controller, such as a computer or a microprocessor control unit (not shown), to stop the inflow of melted metal 111 into the feeder 305. For example, the flow may be stopped by closing a flow valve 128 connecting the conduit 127 to the feeder 305, or stopping the pump 131 or second piston 133 from supplying the melted metal 111 into the feeder 305, as described above and illustrated in FIGS. 2–5. When the lower level detector 313 detects that the level of melted metal has been depleted to a minimum point, it relays a signal to the controller which opens the flow valve 128 or instructs the pump 131 or the second piston 133 to supply additional melted metal 111 into the feeder 305. One or both sensors 311, 313 may be omitted, if desired.

Preferably, sufficient melted metal 111 should be kept in the feeder 305 to supply about 20 times the volume needed for one injection cycle (or shot). This is because the amount of time required to melt the metal necessary for one injection cycle is longer than the injection cycle time, which in the preferred embodiment is about 30 seconds. However, the feeder 305 may contain any level of the melted metal as desired, and the sensor(s) 311, 313 may be located at any height in the feeder 305 to maintain the desired level of the melted metal. A mixer (not shown) in feeder 305 may also be included for the purposes of evenly distributing the heat from the heating elements 309 to the metal 111 supplied to the feeder 305.

The feeder 305, melt furnace 125 and the holding chamber 181 preferably contain an atmosphere of an inert protective gas to minimize oxidizing of the pre-heated and melted metal. A mixture of carbon dioxide ($CO_2$) and sulfur fluoride ($SF_6$) gas is preferred. However, other gasses, such as nitrogen or argon, may be used alone or in any combination with each other. The inert gas may be introduced (e.g. from a pressurized tank) into the feeder 305 through port 315 to create an inert gas atmosphere above the bath. The port 315 may be located on top or side surface of the feeder 305.

The melted metal is subsequently supplied into a temperature-controlled barrel 317 by way of gravity through a feeder port 319 which may optionally be supplied with a valve serving as a stopper (not shown). Preferably, no valve is present. A ram 321 is arranged coaxially with the barrel 317 and extends along the center axis of the barrel 317. The outer diameter of the ram 321 is smaller than the inner diameter of the barrel 317 such that melted metal 111 flows in the space between the ram 321 and the barrel 317. The ram 321 is also controlled by motor 323 for axial movement in both retracting and advancing directions along the barrel 317 and for rotation around its own axis if stirring of the melted metal is desired inside barrel 317.

A valve 325 is mounted around the outer circumference of the ram 321 to separate the barrel 317 into upper and lower portions. The valve 325 opens and closes to selectively permit and block the flow of metal 111 between the upper and lower portions of the barrel 317. Suitable valves having such a function are known per se to those skilled in the art, and any of them may be used for purposes of the present invention. Preferably, the valve 325 is frictionally mounted on an inner circumference of the barrel 317 and slidably mounted on the outer circumference of the ram 321. For example, when the ram 321 retracts upwardly in the barrel 317, the valve 325 moves relative to the ram 321 to permit the flow of melted metal, and when the ram 321 advances downwardly in the barrel 317, the valve 325 moves relative to the ram 321 to block the flow of the melted metal 111.

Figure 33:
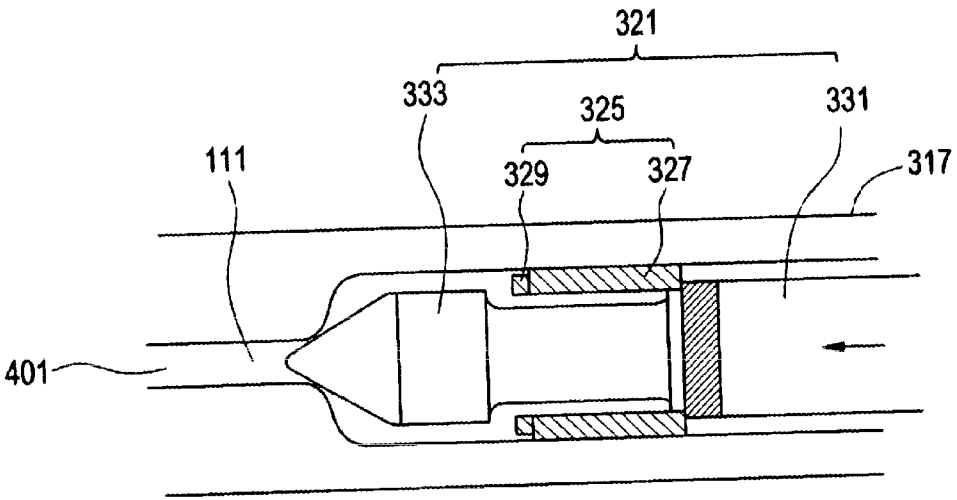
FIG. 33 is a schematic illustration of a side cross sectional view showing one embodiment of a valve on the ram when it is in the position that prevents melted metal from flowing to positions to the right of the valve.
Figure 34:
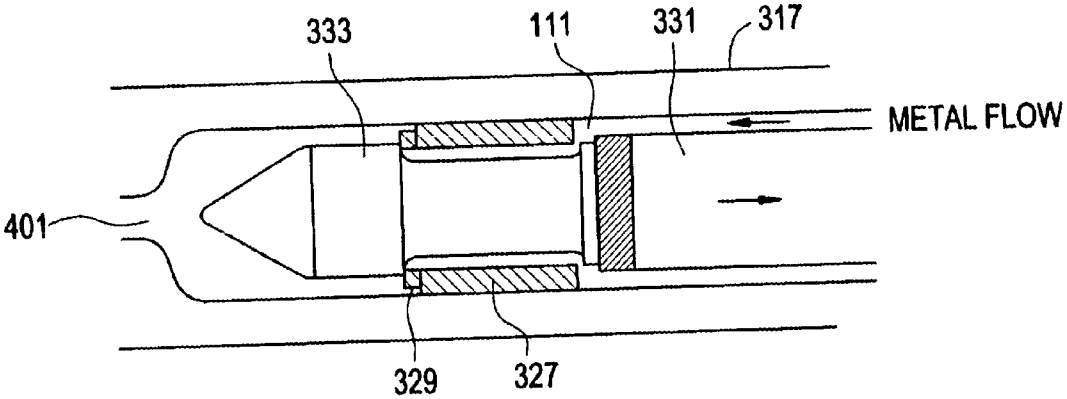
FIG. 34 is a schematic illustration of a side cross sectional view showing one embodiment of a valve on the ram when it is in the position that permits melted metal to flow from the right of the valve to positions to the left of the valve.
Figure 35:
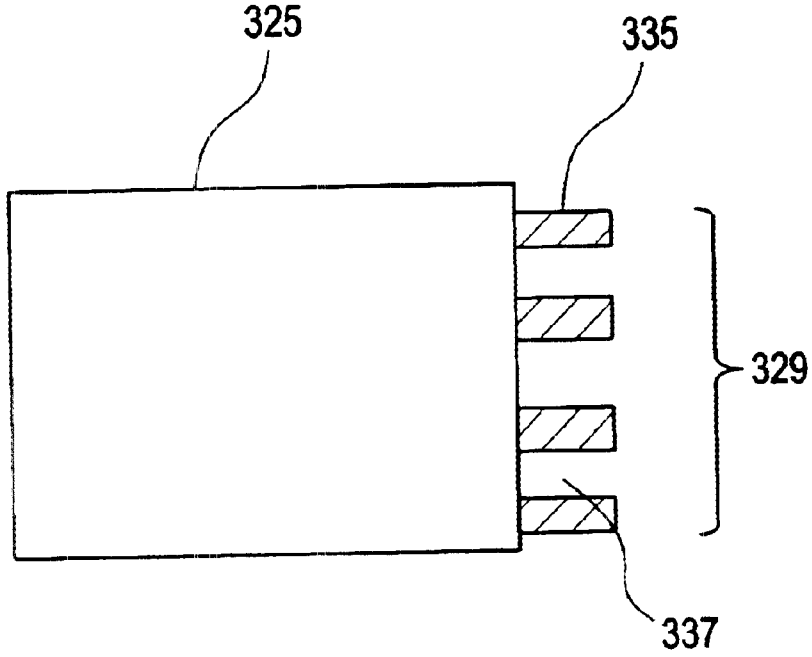
FIG. 35 is a schematic illustration of a side cross sectional view showing one embodiment of a valve when it is not fitted onto the ram.
Figure 36:
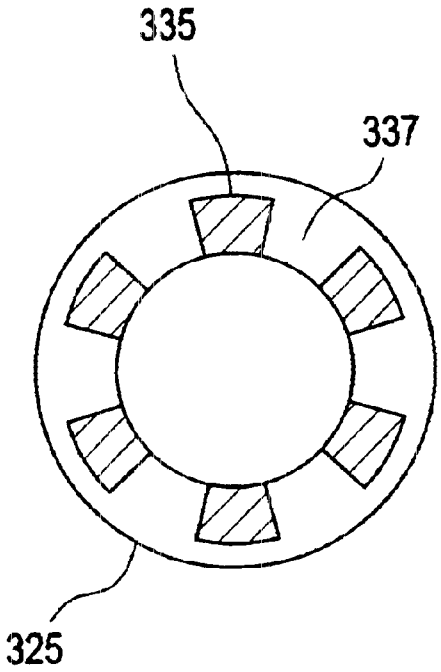
FIG. 36 is a schematic illustration of a front cross sectional view showing one embodiment of a valve when it is not fitted onto the ram.

FIG. 33 is a side view showing one embodiment of a valve on the ram when it is in the position that prevents melted metal from flowing to positions upstream of (to the right of) the valve. FIG. 34 is a side view showing one embodiment of a valve on the ram when it is in the position that permits melted metal to flow downstream of the valve (to the left of the valve). FIG. 35 is a front view showing one embodiment of a valve when it is not fitted onto the ram. FIG. 36 is a side view showing one embodiment of a valve when it is not fitted onto the ram.

In the closed position of FIG. 33, the rear section 327 of the valve 325 abuts the body 331 of the ram 321, while the front section 329 of the valve 325 does not abut the head 333 of the ram 321. Since the rear section 327 of the valve is solid, the melted metal 111 cannot flow between the upper and lower portions of the barrel 317 because the metal flow is blocked by the body 331 of the ram abutting the rear section 327 of the valve. The blockage of the flow in this position permits the ram 321 to push the melted metal 111 in the lower portion of the barrel 317 into the injection chamber 413 through an outlet port 401 (see FIG. 32) without the melted metal 111 flowing back (as shown in FIG. 33) into the upper portion of the barrel 317.

In the open position of FIG. 34, the front section 329 of the valve 325 abuts the head 333 of the ram 321. As illustrated in FIGS. 35 and 36, the front section 329 of the valve contains at least one tooth or prong 335 and at least one gap 337. The melted metal 111 is permitted to flow through the gaps 337 between the teeth 335 when the ram 321 is retracted, as illustrated in FIG. 34. As a result, when the ram 321 is in the retracted position, the valve 325 is in the open position. The melted metal 111 in the upper portion of the barrel 317 flows through the gaps 337 located between the teeth 335, the rear portion 327 of the valve 325 and the head 333 of the ram, and collects in the lower portion of the barrel 317.

The ram 321 as shown in FIGS. 32–34 has a head 333 with a pointed tip, but any shape may be used, including a blunt end or a rounded end. Preferably, the end of ram 321 has a shape capable of blocking outlet port 401 to prevent the flow of melted metal between barrel 317 and injection chamber 413 when ram 321 is fully advanced inside barrel 317.

In an alternative embodiment of the invention, the ram 321 contains at least one optional supporting rib or fin 338 arranged on ram 321, as illustrated in FIG. 32. The fins 338 are preferably attached to the ram 321 and can slide on the inner circumference of the barrel 317, both coaxially with the length of the barrel and/or in a circular motion about the barrel axis. Alternatively, the fins 338 may be attached to the inner circumference of the barrel 317 in such a manner as to allow the bare ram 321 to slide by.

While injection takes place, ram 321 is preferably fully advanced inside barrel 317 so that outlet port 401 is closed, as illustrated in FIG. 33. However, the ram 321 need not be fully advanced since valve 325 and the melted metal 111 that occupies the lower portion of barrel 317 would also prevent melted metal 111 from leaving the injection chamber 413 during injection.

A first piston 419 in the injection chamber 413 is used to inject the melted metal 111 present in the injection chamber 413 into a mold 415 having a cavity 417, as illustrated in FIG. 32. As discussed above, the first piston 419 may have any desired shape, and may extend to the injection nozzle 421 of or to any point in the injection chamber 413 during an injection stroke.

An exemplary injection molding method using the apparatus of FIGS. 32–36 will now be described. A motor (not shown) is used to move the first piston 419 forward to inject the melted metal 111 into the mold cavity 417. Preferably, the melted metal 111 is injected in the liquid state. However, it may also be injected in a thixotropic state, if desired.

After the injection stroke of the first piston 419, the ram 321 is retracted, as illustrated in FIG. 34, but may continue rotating if rotation is being used to stir the melted metal inside barrel 317. The first piston 419 housed in the injection chamber 413 begins retracting (moving to the right as illustrated in FIG. 32) to expand the volume of the injection chamber 413 to a desired volume according to the dimensions of the molded part being produced. The first piston 419 is stopped when the volume of the injection chamber 413 becomes equal to the desired injection volume. The first piston 419 may be retracted at the same time that ram 321 is being retracted or after ram 321 has been retracted to a desired position.

After first piston 419 is stopped, the ram 321 is advanced downward, and, as a result, a portion of the melted metal 111 collected in the lower portion of barrel 317 is pushed into the injection chamber 413 through the outlet port 401, as illustrated in FIG. 33. The pressure of the melted metal 111 entering into injection chamber 413 assists in driving out gas present in the injection chamber 413 that accumulates between the melted metal 111 and first piston 419. The ram 321 preferably advances through barrel 317 until its end closes off outlet port 401, and the ram 321 preferably remains in this position to keep outlet port 401 sealed off until injection is complete and the next shot is started.

During each shot, a certain amount of gas accumulates between the melted metal and the first piston 419 as the melted metal 111 enters injection chamber 413. The volume of this gas can make up as much as 20% of the volume of the injection chamber 413. Injecting such a melted metal/gas mix into a mold can result in molded parts that have uneven surfaces, porosity (caused by gas bubbles trapped in the metal's surface), or other imperfections including those that result from an inconsistent volume of melted metal being injected. Removing as much gas as possible before injection is desired.

In the method of the eighth preferred embodiment of the present invention, that gas evacuation is primarily accomplished in two ways. First, the first piston 419 and injection chamber 413 can evacuate gas like a pharmaceutical syringe that draws in liquid from a container of liquid. Specifically, as first piston 419 retracts, it creates a suction to draw in melted metal 111 from the barrel 317 into the injection chamber 413 and it pushes the gas out behind it. Secondly, the additional portion of melted metal 111 driven into the second chamber by the ram 321 forces the gas that accumulates between the melted metal and the first piston 419 to escape around the small space between the first piston 419 and the wall of the injection chamber (i.e., the gas is forced out to the right of first piston 419 due to the pressure of the melted metal). Optionally, an O-ring seal 423 or other implement may be fitted around at least a portion of first piston 419 that allows the gas to pass behind first piston 419 and out of the system but not back in.

The injection nozzle 421 is preferably covered with a nozzle shut-off plate 425 which is lowered by the controller to prevent the melted metal 111 from escaping out of the injection chamber 413 when the ram 321 pushes the melted metal into the injection chamber 413. When the injection chamber 413 has been filled with the melted metal 111 and substantially all gas has been forced out, the nozzle shut-off plate 425 is pulled up and the nozzle 421 is moved forward (to the left in FIG. 32) to contact the opening in the mold die 415. In a preferred embodiment, the movement of the nozzle 421 is achieved by mounting the injection chamber 413 apparatus on a slide mount (such as a rail and wheels or bearings) and moving the entire injection chamber 413 along with the barrel 317, feeder 305 and/or melt furnace 125, as described above, towards the mold 415 (to the left in FIG. 32). The movement of the injection chamber 413 may be accomplished by the forward stroke of the first piston 419, by the motor used to move the first piston 419 or by a separate motor.

Simultaneously with the movement of the injection chamber 413, the first piston 419 is pushed toward the nozzle 421 to force the melted metal 111 in the injection chamber 413 through the mold die 415 into the mold cavity 417. After a pre-set dwell time, the two mold dies are opened and the molded metallic part is removed, so that a new cycle can begin.

The melted metal, while housed in injection chamber 413, is substantially sealed off from gas that would otherwise enter injection chamber 413 from outside the machine by virtue of nozzle shut-off plate 425, seal 423 on first piston 419, and the melted metal 111 which continuously occupies barrel 317 during operation. Although gas is present in injection chamber 413 prior to start-up, the first run of shots drives out substantially all gas in injection chamber 413. Thus, the melted metal 111 that is injected from injection chamber 413 into mold 415 is substantially free of gas. Preferably, the amount of gas present in injection chamber 413 during injection is less than 20%, more preferably less than or equal to 1% by volume of the second chamber.

As shown in FIG. 32, heating elements 339, 341, 343, 345, 347 and 349 are provided along the length of the barrel 317. Heating elements 427, 429, 431, 433 and 435 are also provided along the length of the injection chamber 413. The heating elements may comprise any heating elements, preferably resistance heating elements. The temperature in the feeder 305 preferably differs depending on the material present in the feeder. For the AZ91 Mg alloy, heating elements 309 are preferably controlled so that the temperature in the feeder 305 is about 640° C. near the upper surface of the melted Mg alloy and about 660° C. near the lower region of feeder 305.

In the barrel 317, the temperature near heating element 339 is preferably maintained at around 640° C. for the AZ91 Mg alloy. The temperature near heating element 343 is preferably maintained at around 650° C. for the AZ91 Mg alloy. The temperature near heating element 349 is preferably maintained at around 630° C. for the AZ91 Mg alloy. The temperature near heating elements 341, 345 and 347 is preferably maintained between the temperature near the adjacent heating elements. These temperatures facilitate the downward flow of metal toward outlet port 401 and inhibit flow in the opposite direction.

In the injection chamber 413, the temperature near heating elements 431, 433 and 435 is preferably maintained at around 620° C. for the AZ91 Mg alloy. These temperatures are sufficiently high to maintain the melted metal entirely in the liquid state from the time it exits the feeder 305 into the barrel 317 to the time the melted metal is injected into the mold cavity 417 from the injection chamber 413. The temperature near heating elements 427 and 429 is preferably maintained at around 570° C. for the AZ91 Mg alloy. The lower temperature behind the seal 423 helps prevent the melted metal 111 from flowing past the seal 423.

Using the preceding temperatures at these locations permits molding of the AZ91 Mg alloy in the liquid state. Under these conditions, one cycle lasts approximately 30 seconds. However, if desired, the processing temperatures may be lowered to maintain the metal in the barrel and/or injection chamber in the thixotropic state.

Molded metallic parts having extremely smooth surfaces and minimal porosity can be produced using the liquid metal injection molding method and apparatus described above, which allows them to be painted directly without any further processing (i.e., after further etching and/or cleaning of the part, but without further machining). The castings also have extremely accurate dimensions and consistency, and can be produced with thicknesses of less than 1 mm when the part roughly has the dimensions of a DIN size A4 sheet of paper (21.0 cm by 29.7 cm). Preferably, the range of thickness of molded parts produced according to the invention is between 0.5 and 1 mm for parts that have roughly the dimensions of a DIN size A4 sheet of paper. With known die casting and thixotropic methods, thicknesses no less than about 1.3 mm can be obtained for parts that have roughly the dimensions of a DIN size A4 sheet of paper.

12. The Two-Chamber Apparatus

Figure 37:
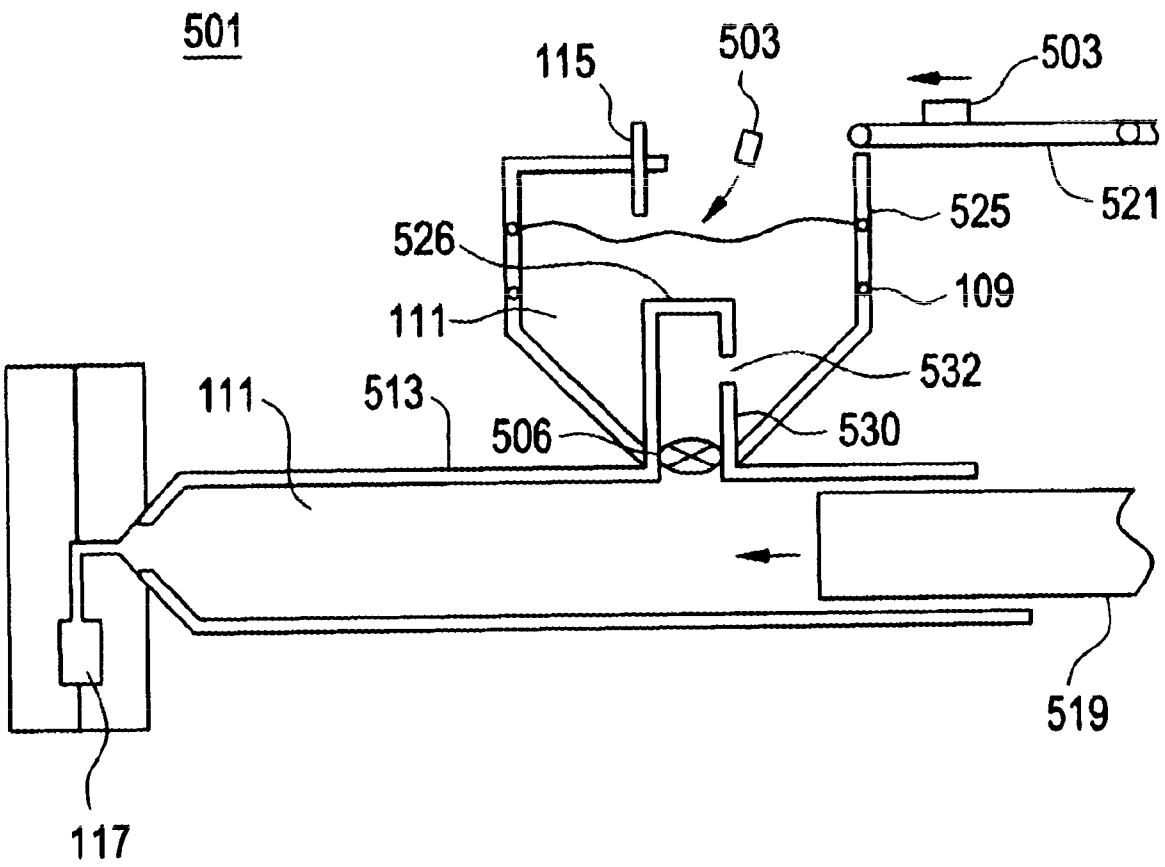
FIG. 37 is a schematic illustration of a side cross sectional view of an injection molding system according to another aspect of the first preferred embodiment of the present invention.

While FIG. 2 illustrates a three chamber apparatus 101, the feeder 105 may be omitted, if desired. In this aspect of the present invention, the injection molding apparatus contains only two chambers: the injection chamber and the melt furnace. An example of such a two chamber apparatus 501 is illustrated in FIG. 37. The reference numbers starting with "5" in this Figure correspond to the reference numbers starting with "1" in FIG. 2, In FIG. 37, the melt furnace 525 is located directly on top of the injection chamber 513. Since the melt furnace 525 moves forward and backward in unison with the injection chamber 513 during each injection stroke of the piston 519, the ingot 103 delivery system 521 should be located over either the forward or backward location of the melt furnace to account for the movement of the melt furnace 525. The delivery system 521 should be operated to deliver the ingots 503 to the melt furnace 525 only when the melt furnace 525 is below the delivery system 521.

Preferably, the melt furnace 525 contains an outlet screening element 526. For example, as illustrated in FIG. 37, the screening element 526 may comprise at least one non-horizontal wall 530, a top cover or portion and an outlet port 532. Preferably, the melt furnace outlet port 532 is located in one of the walls instead of in the top of the screening element 526. The outlet port 532 connects the melt furnace 525 to the conduit 527 leading to the injection chamber 513. The screening element 526 may contain one wall if the element 526 has a cylindrical shape or plural walls if the element 526 has a polygonal shape. Furthermore, the non-horizontal wall 530 is preferably exactly vertical or substantially vertical (i.e., deviating by about 1–20 degrees from vertical).

13. The Check Valve

Figure 38:
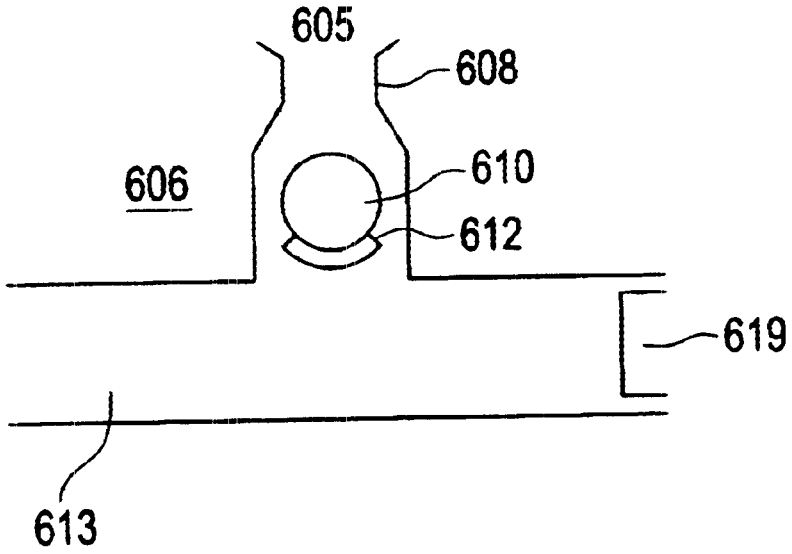
FIGS. 38 and 39 are schematic illustrations of side cross sectional views showing a preferred embodiment of a check valve.
Figure 39:
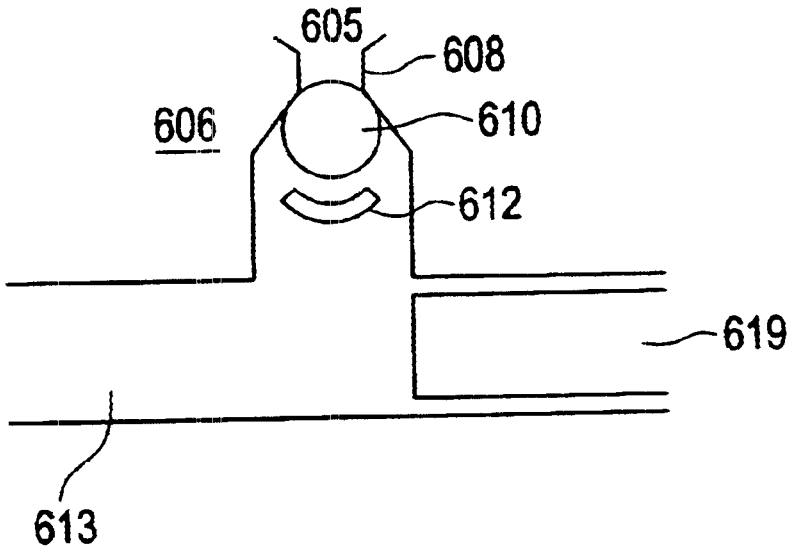

Any check valve 106, 506 may be used in the embodiments illustrated in FIGS. 2–6, 8–11, 13 and 37. FIGS. 38 and 39 illustrate a preferred embodiment of the check valve 106, 506 structure. The preferred check valve is a ball valve 606. The ball valve 606 operates in response to a pressure differential between the feeder 605 and the injection chamber 613. The pressure within the feeder 605 remains somewhat constant, but the pressure within the injection chamber 613 is determined by the position of a piston 619 disposed therein. When the piston 619 is displaced inwardly, the pressure in the injection chamber 613 increases (and becomes higher than that of the feeder 605) and the ball valve 606 closes off an opening 608 between the feeder 605 and the injection chamber 613. When the piston 619 is displaced outwardly, the pressure in the injection chamber 613 decreases and is lower than that of the feeder 605, and the ball valve 606 opens.

The operation of the ball valve 606 is shown in greater detail in FIGS. 38 and 39. FIG. 38 shows the position of the ball valve 606 when the piston 619 is displaced outwardly (away from the mold cavity). In this case, the opening 608 between the feeder 605 and the injection chamber 613 is opened as the ball element 610 of the ball valve 606 moves away from the opening 608. A ball valve stop 612 is provided to confine the ball valve movement away from the opening 608. On the other hand, when the piston 619 is displaced inwardly (toward the mold cavity), as shown in FIG. 39, the pressure inside the injection chamber 613 increases and the ball element 610 of the ball valve 606 is forced to lodge up against the opening 608 and thereby close off fluid communication between the feeder 605 and the injection chamber 613.

In another preferred embodiment, the ball valve 606 may be provided with a biasing element, such as a spring. In such a case, the ball element 610 may be biased towards either the open or the closed position. It is preferable to provide such a biasing element in larger injection molding systems for producing metal alloys. In still another preferred embodiment, the ball valve 606 may be electronically controlled, in which the opening and closing of the ball valve is synchronized with the displacement motion of the piston 619.

14. Conclusion

It is important to note that all embodiments described above and illustrated in FIGS. 2–36 may be used together or separately or in any combination or permutation without departing from the scope of the current invention. For example, any one or more improvements shown in FIGS. 3–20 may be added to the basic apparatus shown in FIG. 2 without departing from the scope of the current invention. Furthermore, each feature of the delivery system illustrated in FIGS. 21–31 and/or each feature of the injection system illustrated in FIGS. 32–36 may be added to the basic apparatus shown in FIG. 2 without departing from the scope of the current invention.

Furthermore, each feature described above is considered to be separate invention. For example, the ingot or pellet delivery system(s) described above and illustrated in FIGS. 21–31 and the injection system illustrated in FIGS. 32–36 may be used separately or together in a apparatus that does not contain a melt furnace.

In the preceding discussion of the preferred embodiments, a metal alloy is produced by injection molding from a magnesium (Mg) alloy ingot or pellets which are melted and processed in a liquid state. The invention is not limited to processing of Mg and is equally applicable to other types of materials, metals and metal alloys. Furthermore, the chamber where the metal is melted is referred to as the "melt furnace" 125. However, this chamber may also be referred to as a "melting pot."

The terms "melted metal" and "melted material" as used herein encompass metals, metal alloys and other materials which can be converted to a liquid state and processed in an injection molding system. A wide range of metals is potentially useful in this invention, including aluminum (Al), Al alloys, zinc (Zn), Zn alloys, titanium (Ti), Ti alloys, and the like.

Unless otherwise indicated, the terms "a" or "an" refer to one or more. Unless otherwise indicated, the term "gas" refers to any gas (including air) that can be present in the injection chamber at start-up or that is trapped in the injection chamber and forced out during operation of the invention's system. Specific temperature and temperature ranges cited in the following description of the preferred embodiment are applicable to the preferred embodiment for processing Mg alloy in a liquid state, but could readily be modified in accordance with the principles of the invention by those skilled in the art in order to accommodate other metals and metal alloys. For example, some Zn alloys become liquid at temperatures above 450° C., and the temperatures in the injection molding system of the present invention can be adjusted for processing of Zn alloys.

While particular embodiments according to the invention have been illustrated and described above, it will be clear that the invention can take a variety of forms and embodiments within the scope of the appended claims.

What is claimed is:

1. An injection molding apparatus comprising:

a first chamber means for melting a solid material;

a second chamber means for holding the melted material;

a third chamber means for holding the melted material to be transferred into a mold cavity;

a first conduit means for transferring the melted material from the first chamber means to the second chamber means;

a means for moving the second chamber means and the third chamber means toward the mold cavity;

a means for preventing movement of the first chamber means during the step of moving the second chamber and the third chamber toward the mold cavity;

a second conduit means for transferring the melted material from the second chamber means to the third chamber means;

a first piston means in the third chamber means for transferring the melted material from the third chamber means to a mold cavity; and a screening element adjacent to a bottom of the first chamber means, the screening element comprising at least one non-horizontal wall and a top wall enclosing an interior volume and having a first outlet on the at least one non-horizontal wall, the first outlet comprising an opening into the interior volume of the screening element and the at least one non-horizontal wall circumscribing a second outlet in the bottom of the first chamber means.

2. The apparatus of claim 1, wherein:

the melted material comprises a metal in a liquid state; and the solid material comprises a metal ingot or a metal pellet.

3. The apparatus claim 2, wherein the metal comprises a magnesium alloy.

4. The apparatus of claim 2, further comprising:

a fourth chamber means for heating the metal ingot or metal particle; and a third conduit means for transferring the at least one metal ingot or metal pellet from the fourth chamber means into the first chamber means.

5. The apparatus of claim 4, further comprising a protective gas supply means for supplying a protective gas comprising at least one of argon, nitrogen, $SF_6$ and $CO_2$ into at least one of the first chamber means, the second chamber means or the fourth chamber means.

6. The apparatus of claim 5, wherein the fourth chamber means further comprises at least one of:

at least one door;

a vacuum pump; or at least one protective gas screen.

7. The apparatus of claim 6, further comprising an ingot delivery means for delivering metal ingots to the fourth chamber.

8. The apparatus of claim 2, further comprising a first valve means for controlling the flow of the metal in the liquid state through the first conduit means.

9. The apparatus of claim 2, wherein the first chamber means is located above the second chamber means for gravity feeding the metal in the liquid state through the first conduit means.

10. The apparatus of claim 2, further comprising a pump means for pumping the metal in the liquid state through the first conduit means.

11. The apparatus of claim 2, further comprising an injection means for injecting the metal in the liquid state through the first conduit means.

12. The apparatus of claim 11, wherein the injection means comprises:

a second piston means for drawing by suction the metal in the liquid state from the first chamber into a temporary holding chamber and for injecting the metal in the liquid state from the temporary holding chamber into the second chamber through the first conduit means; and a second valve means for controlling the flow of the metal in the liquid state between the first chamber and the temporary holding chamber.

13. The apparatus of claim 2, wherein metal is transferred from the fourth chamber means to the third chamber means by:

gravity feeding the metal from a fourth chamber means into the third chamber means;

creating a suction in the third chamber means to draw at least a first portion or the metal from the fourth chamber means into the third chamber means; and pushing at least a second portion of the metal remaining in the fourth chamber means into the third chamber means.

14. The apparatus of claim 1, further comprising a plate means for controlling access to the first chamber.

15. The apparatus of claim 1, further comprising a transfer chamber means for controlling access to the first chamber.

16. The apparatus of claim 1, further comprising a rotation means for rotating the first conduit means.

17. The apparatus of claim 1, wherein the function of transferring the melted material from the third chamber means to a mold cavity performed by the first piston means comprises:

moving the first piston means toward the mold cavity to inject a metal in a liquid or a thixotropic state from the third chamber into the mold cavity; and simultaneously moving the second chamber and the third chamber toward the mold cavity.

18. The apparatus of claim 17, wherein the first conduit means comprises one of:

a bendable pipe means for bending to allow the movement of the second and third chambers away from the first chamber; or a rotatable pipe means for rotating to allow the movement of the second and third chambers away from the first chamber.

19. The apparatus of claim 17, further comprising roller means supporting the first chamber for moving the first chamber toward the mold cavity simultaneously with moving the second chamber and the third chamber toward the mold cavity.

20. The apparatus of claim 19, further comprising a motor means for simultaneously actuating at least two of the following:

a) movement of the first chamber means toward the mold cavity;

b) the second piston means for injecting the metal in the liquid state from a temporary holding chamber into the second chamber through the first conduit means; and c) the first piston means in the third chamber means for transferring the melted material from the third chamber means to the mold cavity.

21. The apparatus of claim 19, further comprising:

a support means for supporting the first chamber; and a drive actuating means for moving the support means and the first chamber means toward the mold cavity.

22. An injection molding apparatus, comprising:

a melt furnace suitable for melting a metal;

a feeder suitable for holding the melted metal;

an injection chamber containing a first piston and an injection nozzle;

a temperature controlled barrel between the feeder and the injection chamber;

a first conduit connecting the melt furnace to the feeder;

a second conduit connecting the feeder to the temperature controlled barrel; and a screening element adjacent to a bottom of the melt furnace, the screening element comprising at least one non-horizontal wall and a top wall enclosing an interior volume and having a first melt furnace outlet on the at least one non-horizontal wall, the first melt furnace outlet comprising an opening into the interior volume of the screening element and the at least one non-horizontal wall circumscribing a second melt furnace outlet in the bottom of the melt furnace, wherein the feeder and the injection chamber are movable toward a mold cavity with each forward stroke of the first piston.

23. The apparatus of claim 22, further comprising:

a preheating chamber suitable for heating a metal ingot or metal particle to drive off moisture; and a third conduit connecting the preheating chamber to the melt furnace.

24. The apparatus as claimed in claim 23, further comprising:

an elevator suitable for delivering metal ingots; and a first conveyor between the elevator and the preheating chamber.

25. The apparatus as claimed in claim 24, wherein the elevator comprises:

at least one rotatable platform;

at least one connector about which the platform rotates; and a lifting member which lifts up the platform causing it to rotate about the connector.

26. The apparatus of claim 23, wherein at least one of the melt furnace, the feeder and the preheating chamber contain a first and second protective gas supply pipes.

27. The apparatus of claim 23, wherein the preheating chamber further comprises at least one of:

a push arm;

a third piston;

at least one door;

a vacuum pump; or at least one protective gas screen.

28. The apparatus of claim 23 wherein the third conduit comprises a downward sloping surface or a second conveyor.

29. The apparatus of claim 22, further comprising a cover plate, an aperture plate or a transfer chamber adjacent to an access to the feeder.

30. The apparatus of claim 22, further comprising a gear connected to the first conduit and a rotation motor connected to the gear.

31. The apparatus of claim 22, further comprising a first valve inside the first conduit or adjacent to the first conduit.

32. The apparatus of claim 22, wherein the melt furnace is located above the feeder to allow gravity feeding of a metal in a liquid state through the first conduit.

33. The apparatus of claim 22, further comprising a pump connected to the first conduit.

34. The apparatus of claim 22, further comprising a second piston connected to the first conduit.

35. The apparatus of claim 34, further comprising:

a temporary holding chamber containing the second piston;

a third conduit connecting the melt furnace and the temporary holding chamber; and a second valve inside the third conduit or adjacent to an outlet of the third conduit.

36. The apparatus of claim 35, further comprising an inlet chamber connecting the first conduit and the feeder through an inlet nozzle.

37. The apparatus of claim 22, further comprising a bolt, a weld or a clamp preventing movement of the melt furnace during each forward stroke of the first piston.

38. The apparatus of claim 37, wherein the first conduit comprises one of:

a bendable pipe, bending to allow the movement of the feeder and the injection chamber away from the melt furnace; or a rotatable pipe, rotating to allow the movement of the feeder and the injection chamber away from the melt furnace.

39. The apparatus of claim 22, further comprising wheels or bearings supporting the melt furnace.

40. The apparatus of claim 39, further comprising a first motor connected to the first piston and to a second piston, such that the motor simultaneously actuates each forward stroke of the first piston and the second piston.

41. The apparatus of claim 40, wherein the first piston is positioned parallel to the second piston.

42. The apparatus of claim 39, further comprising:

a frame supporting the melt furnace; and a screw positioned such that its forward rotation advances the frame and the melt furnace toward the mold cavity.

43. The apparatus of claim 22, further comprising a screening element adjacent to a bottom of the melt furnace, comprising at least one non-horizontal wall, a top and a melt furnace outlet on at least one wall.

44. The apparatus of claim 22, further comprising:

a valve adjacent a melt furnace outlet;

a grate adjacent a melt furnace outlet; or at least one containment rod adjacent a melt furnace outlet.

45. The apparatus of claim 44, wherein the valve comprises a ball valve.

46. The apparatus of claim 22, wherein the inner diameter of the first conduit is 25 to 45 mm.

47. The apparatus of claim 22, further comprising:

a ram that moves through said barrel to force at least a portion of a metal in a liquid or thixotropic state from the barrel through an outlet port leading into the injection chamber; and a first motor which:

(a) retracts the first piston to create suction that assists in drawing into the injection chamber at least a portion of the melted metal through the outlet port from the barrel; and (b) advances the first piston to inject the metal in a liquid or a thixotropic state into a mold.

48. The apparatus of claim 47, wherein:

the barrel is located above the injection chamber to allow gravity to assist passage of the metal from the barrel into the injection chamber; and further comprising a valve at one end of the barrel that permits the metal to pass only in a direction toward the outlet port.

49. An injection molding apparatus, comprising:

a melt furnace suitable for melting a metal;

a screening element adjacent to a bottom of the melt furnace, the screening element comprising at least one non-horizontal wall and a top wall enclosing an interior volume and having a first melt furnace outlet on the at least one non-horizontal wall, the first melt furnace outlet comprising an opening into the interior volume of the screening element and the at least one non-horizontal wall circumscribing a second melt furnace outlet in the bottom of the melt furnace;

an injection chamber containing a piston and an injection nozzle; and a conduit leading from the interior volume of the screening element toward the injection chamber.

50. The apparatus of claim 49, wherein the non-horizontal wall is substantially vertical.

51. The apparatus of claim 50, further comprising:

a temperature controlled barrel located between the melt furnace and the injection chamber.

52. The apparatus of claim 50, further comprising:

a temperature controlled barrel located between the melt furnace and the injection chamber;

a ram that moves through said barrel to force at least a portion of a metal in a liquid or a thixotropic state from the barrel through an outlet port leading into the injection chamber; and a first motor which:

(a) retracts the first piston to create suction that assists in drawing into the injection chamber at least a portion of the melted metal through the outlet port from the barrel; and (b) advances the first piston to inject the metal in a liquid or a thixotropic state into a mold.

53. The apparatus of claim 52, wherein:

the melt furnace is located above the temperature controlled barrel;

the temperature controlled barrel is located above the injection chamber; and the injection chamber is horizontally disposed.

54. The apparatus of claim 49, wherein the melt furnace is located above the injection chamber.

* * * * *